US008156931B2

(12) United States Patent
Jacklich et al.

(10) Patent No.: US 8,156,931 B2
(45) Date of Patent: Apr. 17, 2012

(54) DIRECT VENT CAP

(75) Inventors: John R. Jacklich, Napa, CA (US); Eric Adair, Dixon, CA (US)

(73) Assignee: M&G Duravent, Inc., Vacaville, CA (US)

( * ) Notice: Subject to any disclaimer, the term of this patent is extended or adjusted under 35 U.S.C. 154(b) by 1378 days.

(21) Appl. No.: 11/118,702

(22) Filed: Apr. 29, 2005

(65) Prior Publication Data

US 2006/0243268 A1 Nov. 2, 2006

(51) Int. Cl.
*F24C 3/00* (2006.01)

(52) U.S. Cl. ..... 126/85 B; 126/84; 126/299 R; 126/307 A; 126/307 R; 126/312; 454/339; 454/359; 454/361; 454/367

(58) Field of Classification Search ..... 454/339, 454/8, 33, 35, 39, 40, 243, 43, 359, 361, 454/367; 126/85 B, 312, 307 R, 84, 319, 126/307 A, 299 R
See application file for complete search history.

(56) References Cited

U.S. PATENT DOCUMENTS

| | | | | | |
|---|---|---|---|---|---|
| 424,778 | A | | 4/1890 | Gee | |
| 757,348 | A | | 4/1904 | Ross | |
| 1,064,592 | A | | 6/1913 | Arnold | |
| 2,239,767 | A | * | 4/1941 | Anderson | 454/115 |
| 2,711,683 | A | | 6/1955 | Ryder | |
| 2,755,794 | A | | 7/1956 | Wendell | |
| 3,136,309 | A | | 6/1964 | Martz | |
| 3,435,816 | A | * | 4/1969 | De Werth | 126/85 B |
| RE27,943 | E | * | 3/1974 | Smith | 454/365 |
| 3,874,363 | A | | 4/1975 | Biedenbender et al. | |
| 3,994,280 | A | | 11/1976 | Winters et al. | |
| 4,138,062 | A | | 2/1979 | Graden | |
| 4,280,399 | A | * | 7/1981 | Cunning | 454/365 |
| 4,349,009 | A | | 9/1982 | Patterson et al. | |
| 4,580,548 | A | | 4/1986 | Ono | |
| 4,757,802 | A | * | 7/1988 | Guzorek | 126/80 |
| 4,759,272 | A | * | 7/1988 | Zaniewski | 454/344 |
| 4,817,506 | A | * | 4/1989 | Cashman | 454/365 |
| 4,843,794 | A | * | 7/1989 | Holtgreve | 52/199 |
| 4,850,166 | A | * | 7/1989 | Taylor | 52/199 |
| 4,893,608 | A | | 1/1990 | Reaser | |
| 4,942,699 | A | * | 7/1990 | Spinelli | 52/57 |
| 4,965,971 | A | * | 10/1990 | Jean-Jacques et al. | 52/199 |
| 5,009,149 | A | * | 4/1991 | MacLeod et al. | 454/365 |
| 5,022,203 | A | * | 6/1991 | Boyd | 52/199 |
| 5,288,269 | A | * | 2/1994 | Hansen | 454/365 |
| 5,326,318 | A | * | 7/1994 | Rotter | 454/365 |
| 5,339,582 | A | * | 8/1994 | Sells | 52/198 |
| 5,451,183 | A | | 9/1995 | Dahlin | |
| 5,457,920 | A | * | 10/1995 | Waltz | 52/199 |
| 5,458,538 | A | * | 10/1995 | MacLeod et al. | 454/365 |
| 5,562,088 | A | | 10/1996 | Valters et al. | |
| 5,673,521 | A | * | 10/1997 | Coulton et al. | 52/199 |
| 5,680,856 | A | | 10/1997 | van Dijk | |
| 5,697,842 | A | * | 12/1997 | Donnelly | 454/365 |
| 5,704,834 | A | * | 1/1998 | Sells | 454/365 |

(Continued)

*Primary Examiner* — Steven B McAllister
*Assistant Examiner* — Avinash Savani
(74) *Attorney, Agent, or Firm* — Vierra Magen Marcus & DeNiro LLP

(57) ABSTRACT

A vent cap for a direct vent system. The cap may include a base plate and a semicircular outer housing secured to the base plate. A divider is coupled within the outer housing, with the divider forming in exhaust region and an inlet region. A heat shield is positioned within the semicircular outer housing in the outlet region. A direct vent pipe coupling is provided in the base plate and includes a first pipe having an outlet coupled to the divider.

32 Claims, 20 Drawing Sheets

U.S. PATENT DOCUMENTS

| | | | | |
|---|---|---|---|---|
| 5,715,808 | A | 2/1998 | Wilhoite | |
| 5,772,502 | A * | 6/1998 | Smith | 454/365 |
| 5,797,222 | A * | 8/1998 | Martin | 52/198 |
| 5,803,805 | A * | 9/1998 | Sells | 454/364 |
| 5,924,925 | A * | 7/1999 | Nystrom | 454/365 |
| 6,128,870 | A * | 10/2000 | Kohler | 52/199 |
| 6,149,517 | A * | 11/2000 | Hansen | 454/365 |
| 6,185,880 | B1 * | 2/2001 | Richardson | 52/198 |
| 6,277,024 | B1 * | 8/2001 | Coulton | 454/365 |
| 6,289,886 | B1 * | 9/2001 | Radke | 126/85 B |
| 6,361,434 | B1 * | 3/2002 | Brandon | 454/365 |
| 6,371,847 | B2 * | 4/2002 | Headrick | 454/365 |
| 6,484,712 | B1 * | 11/2002 | Lyons et al. | 126/85 B |
| 6,537,147 | B2 * | 3/2003 | Smith | 454/365 |
| 6,598,353 | B1 * | 7/2003 | Reeves | 52/57 |
| 6,623,354 | B2 * | 9/2003 | Morris et al. | 454/365 |
| 6,662,509 | B2 * | 12/2003 | Sharp et al. | 52/199 |
| 6,684,581 | B2 * | 2/2004 | Robinson et al. | 52/198 |
| 6,746,324 | B2 * | 6/2004 | Achen | 454/283 |
| 6,773,341 | B2 * | 8/2004 | Cedergreen et al. | 454/365 |
| 2002/0195097 | A1 * | 12/2002 | Lesage | 126/85 B |

* cited by examiner

DIRECT VENT CAP

BACKGROUND OF THE INVENTION

1. Field of the Invention

The present invention is directed to venting of direct vent combustible devices.

2. Description of the Related Art

Direct vent gas stoves and fireplaces are appliances that use a flue to vent combustion waste outside of a dwelling via the most direct route. Venting can occur either vertically, through a wall, generally referred to as a rear vent, or up through the ceiling, generally referred to as a top vent. The key advantage to direct vent appliances is that they are independent of room air and use their own combustion air. Direct vent units are pre-assembled in the factory, are usually made from metal and are made to be easy to install.

Perhaps the biggest advantage of a direct vent fireplace over a gas fireplace using a chimney is that the flue is much smaller in diameter than the average chimney. This means that less heat is lost through the flue than would be through a chimney.

In direct venting, room air is not used for combustion. Rather, air used for combustion is drawn into the combustion chamber by use of a vent which is exposed to the outside ambient air. A direct vent pipe includes two ducts formed by an inner pipe surrounded by a larger diameter outer pipe. A first duct connected to the vent conveys this outside air to the combustion chamber. After combustion, this air and the combustion byproducts are conveyed directly to the vent through a second duct which is isolated from the first duct. The two ducts are typically cylindrical and can be concentric, with the inlet air being conducted to the combustion chamber through an annulus outside the exit air duct and the exit air being conducted to the vent by way of the inner duct, co-linear (or side-by-side), or completely separate ducts.

Vent caps cover the inlet/outlet of the first and second ducts on the outside of a dwelling. One prior art vent typically used two flat plates located a distance away from the outlet of the exit duct. The inner flat plate, which is the plate closest to the exit duct, is impacted by the combustion exhaust products. Because it thereby became heated, a second or outer flat plate of virtually the same dimensions was separated a distance from the first plate to prevent burns. A third plate with a centre hole was provided between the first plate and the outlet of the exhaust duct. Another prior art cap is shown in U.S. Pat. No. 6,289,886. The cap shown therein utilizes a curved outer cover with an accurately shaped inner surface to dissipate exhaust gases. No "second plate" separates this accurately shaped surface from impact gasses.

Winds and drafts around the vent cap can also affect the backpressure in the duct. If there is backpressure present in the exit duct, the draw of inlet air will be reduced which will decrease combustion efficiency and can lead, in poorly designed systems, to extinguishing the combustion flame.

SUMMARY OF THE INVENTION

The present invention, roughly described, pertains to a vent cap for a direct vent system. The cap may include a base plate and a semicircular outer housing secured to the base plate. A divider is coupled within the outer housing, with the divider forming in exhaust region and an inlet region. A heat shield is positioned within the semicircular outer housing in the outlet region. A direct vent pipe coupling is provided in the base plate and includes a first pipe having an outlet coupled to the divider.

In one embodiment, the heat shield has an arcuate shape generally matching a cross-sectional shape of the semicircular outer housing.

In another embodiment, a vent cap for a direct vent system includes a backing plate, a first semicircular outer housing secured to a first portion of the backing plate and a second semicircular outer housing secured to a second portion of the backing plate. A divider is coupled within the first outer housing, with the divider forming in exhaust region and an inlet region. A heat shield is positioned within the first semicircular outer housing in the outlet region. A direct vent pipe coupling is positioned in the second portion of the backing plate. A vent pipe stem is provided in the first and second housings and connecting one duct of the pipe coupling to the divider.

Another embodiment of the vent cap comprises a backing plate, a first arcuate outer housing secured to a first portion of the backing plate, a second arcuate outer housing secured to a second portion of the backing plate and a third semicircular outer housing secured to a third portion of the backing plate, between the first and second portions. A divider is coupled within the third outer housing, the divider forming in exhaust region and an inlet region. A heat shield is positioned within the third semicircular outer housing in the outlet region, and a direct vent pipe coupling is provided in the backing plate.

These and other objects and advantages of the present invention will appear more clearly from the following description in which the preferred embodiment of the invention has been set forth in conjunction with the drawings.

WRITTEN DESCRIPTION

A unique vent cap for use in conjunction with a direct vent appliance and venting system provides a number of advantages over conventional vent caps. Numerous embodiments of the vent cap of the present invention are disclosed. It will be recognized that various combinations of components of each embodiment may be substituted for components disclosed with other embodiments, providing numerous variations of the cap, all of which are intended to be within the scope of the attached claims.

FIGS. 1-8 show a first embodiment of the vent cap present invention. The vent cap 100 shown in FIGS. 1-8 is advantageously used in conjunction with a two duct, direct vent pipe coupled to a direct vent appliance. Two duct vent pipe such as that commercially available from Simpson Dura-Vent Company, Vacaville, Calif., is suitable for use with the present invention. Numerous sizes of direct vent pipe exist. Typical sizes are 3×4.625" (so called "3×4" pipe) 4×6⅝" (often referred to as "4×6" pipe), and "5×8," referring to the diameter of the inner pipe and the outer pipe, respectively. The invention is not limited by the type or size of pipe coupled to the vent cap.

Figure 1:
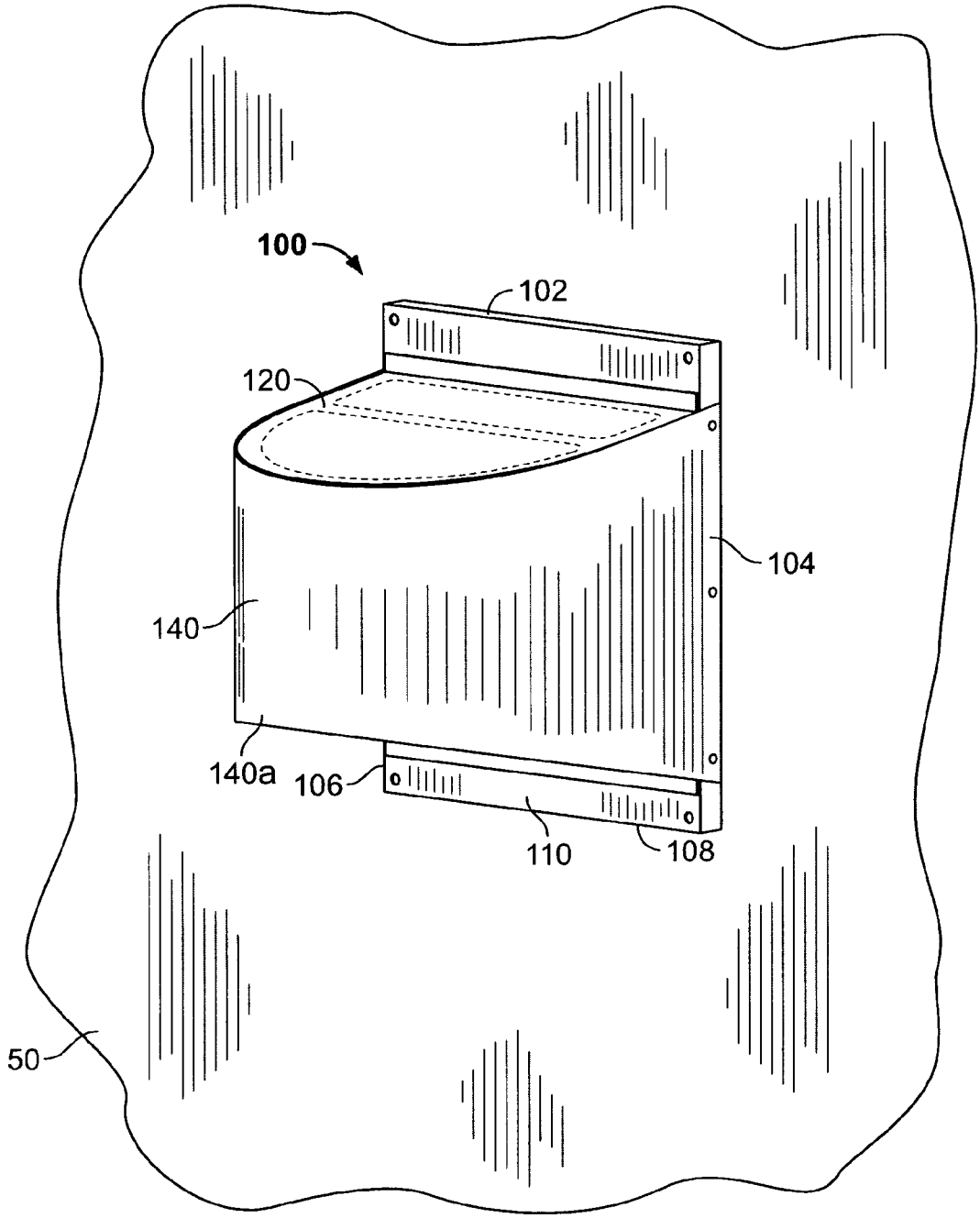
FIG. 1 is a first perspective view of a first embodiment of a vent cap in accordance with the present invention.
Figure 2:
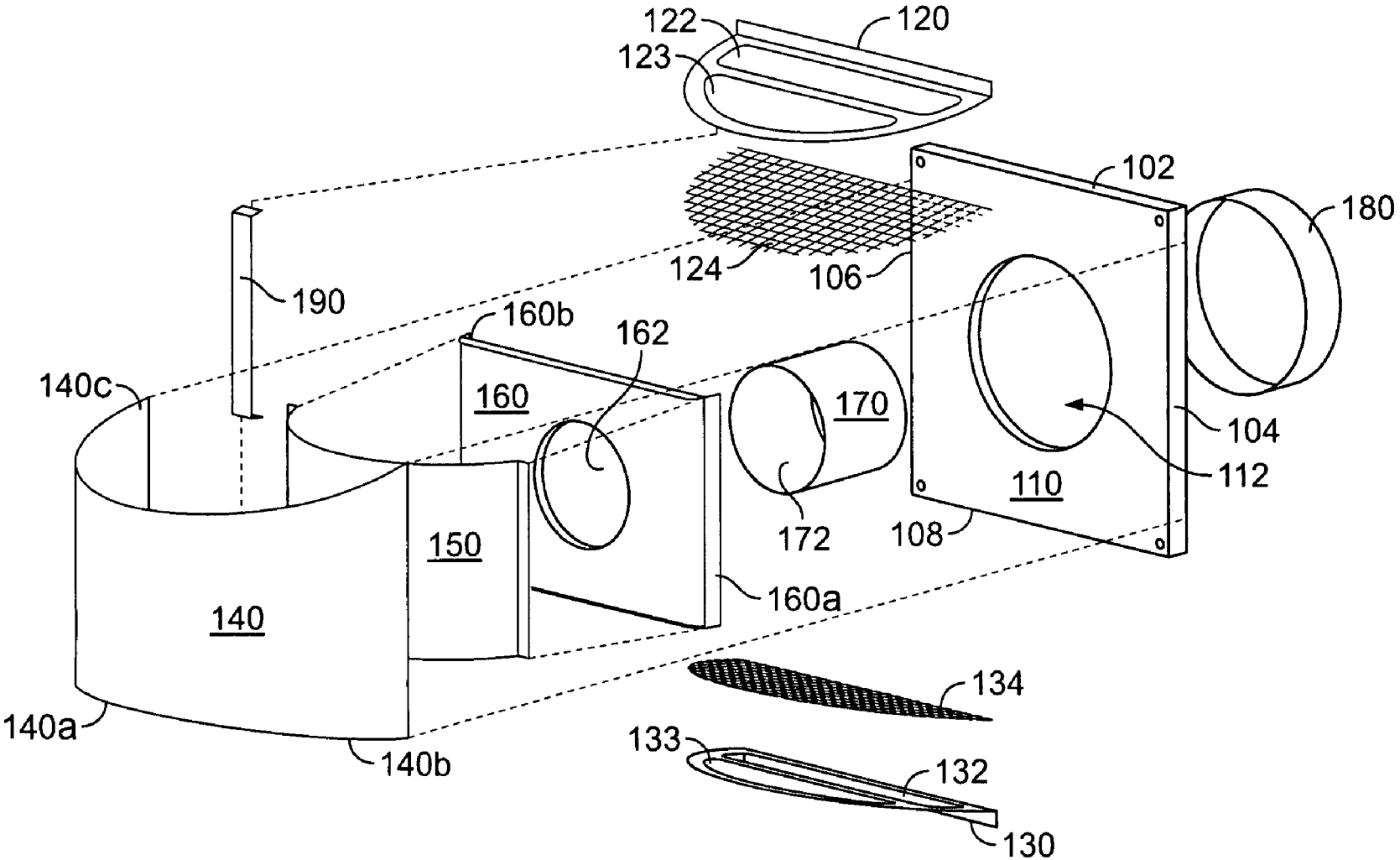
FIG. 2 is an exploded view of the components making up the first embodiment of a vent cap in accordance with the present invention.
Figure 3:
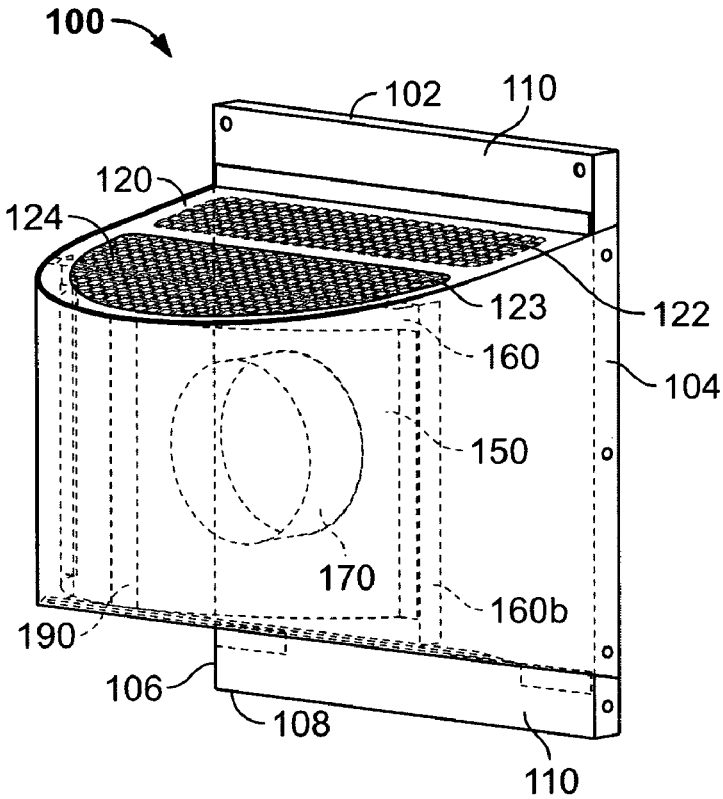
FIG. 3 is a second perspective view of the first embodiment of the vent cap of the present invention.
Figure 4:
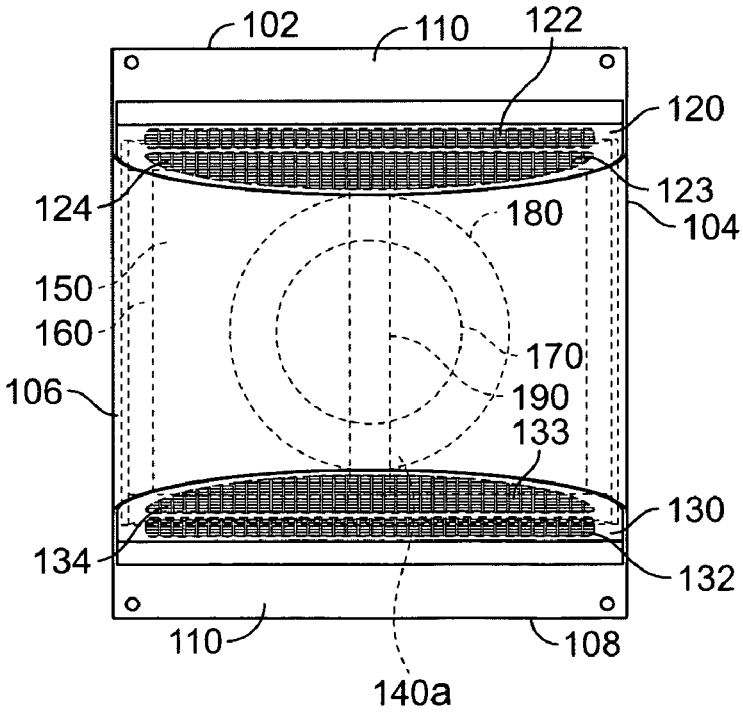
FIG. 4 is a front view of the first embodiment of the vent cap of the present invention.
Figure 5:
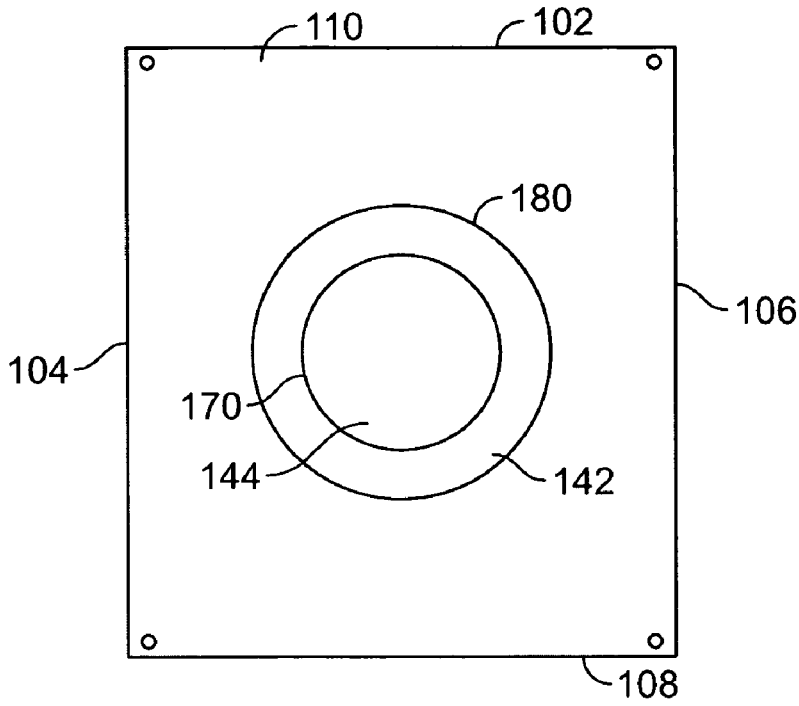
FIG. 5 is a rear view of the first embodiment of the vent cap of the present invention.

With reference to FIGS. 1 and 2, vent cap 100 includes a back plate 110 to which a number of components shown in FIG. 2 are mounted, resulting in the assembled structure shown in FIGS. 1, and 3-8. The vent cap 100 is designed to be mounted to the exterior wall 50 of a dwelling at a height of about 12 inches above the ground or foundation of a building. The cap is mounted to the exterior by securing the backing plate 110 directly to the exterior of the building using any of a number of suitable fastening methods, and thereafter securing the direct vent pipe thereto.

Backing plate 110 has a top-side 102, a left-side 106, a right-side 104, and a bottom-side 108. Where cap 100 is designed for use with 4×6⅝-⅝" pipe, each side 102, 104, 106, 108 may have a length of about 9". It will be recognized that any number of suitable sizes may be used with the invention.

Figure 7:
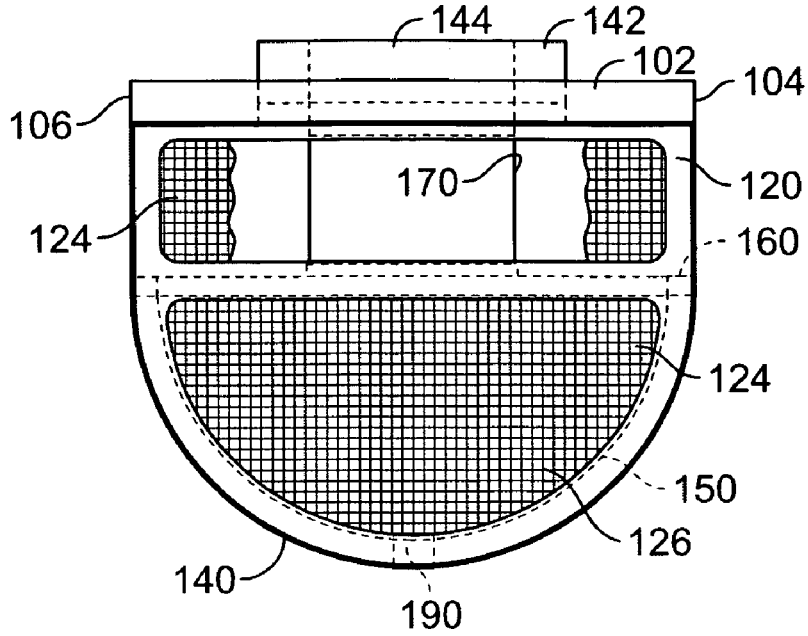
FIG. 7 is a top view of the first embodiment of the vent cap of the present invention.
Figure 8:
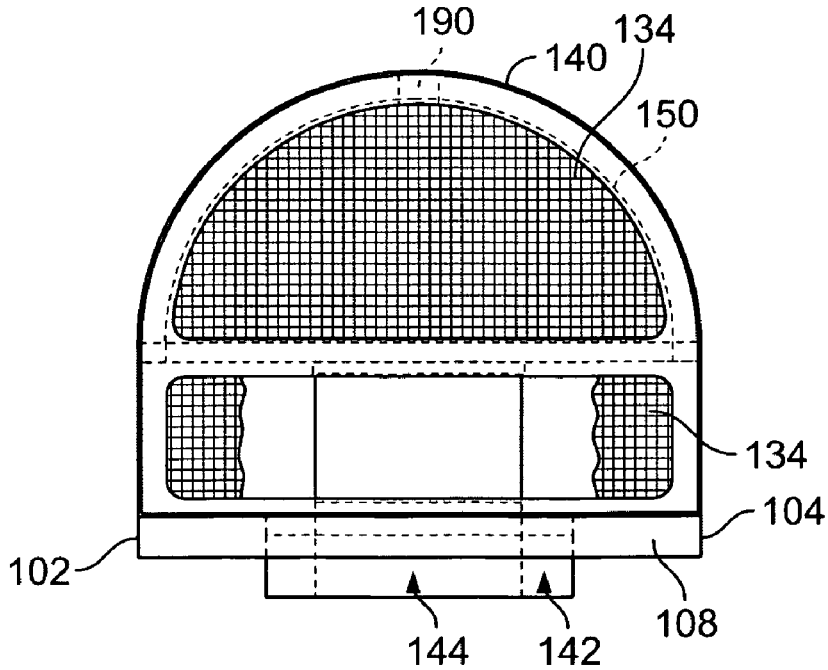
FIG. 8 is a bottom view of the first embodiment of the vent cap of the present invention.
Figure 9:
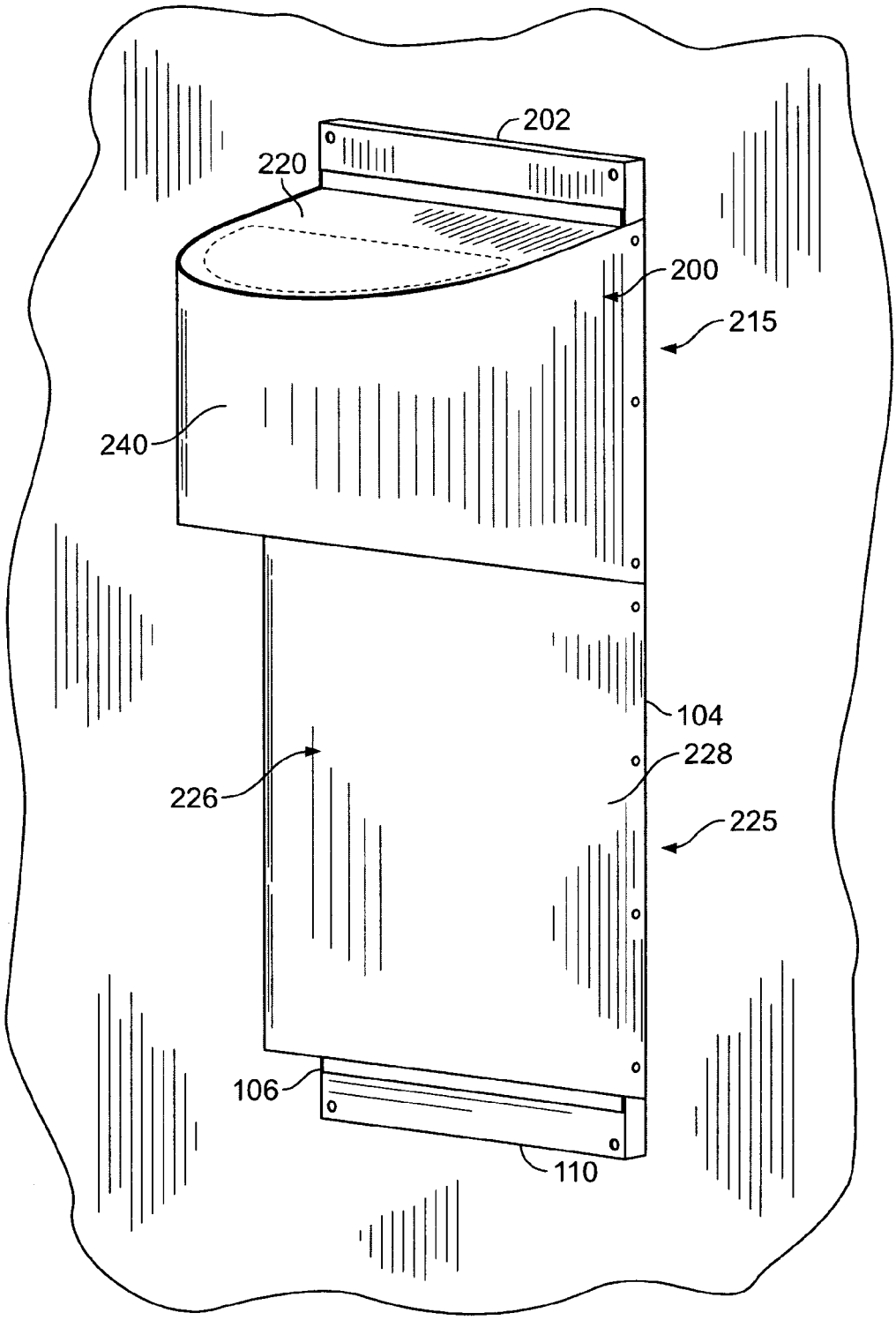
FIG. 9 is a perspective view of a second embodiment of the vent cap of the present invention.

An outer cover 140 having a semi-circular assembled cross-section (when viewed from the top or bottom as illustrated in FIGS. 7 and 8) is coupled by welding, bolting, riveting, or other suitable fastening means cover 140 to back plate 110. Cover 140 may be formed by any of a number of 300 or 400 grade stainless steel, and is formed by cutting a flat plate of steel such that cover 140 has a narrower apex 140*a* than edges 140*b*, 140*c* which attach to sides 104, 106 back plate 110. Edges 140*b*, 140*c* may have a length of about 7" in the 4×6⅝" size pipe embodiment of the cap 100. This shorter apex causes covers 120, 130 to be angled with respect to backing plate 110 by approximately 80 degrees, further causing the intake region (described below) to be somewhat higher than the exhaust region. In one embodiment, cover 140 serves as structural support for a divider 160. Divider 160 is coupled to the outer cover 140 by welding, by press fitting the sleeve into the bore, or by other suitable means. It will be recognized by one of average skill that alternatives exist for coupling the divider 160 within the outer housing. For example, divider 160 may be coupled to backing plate 110 by connectors (not shown), alone or in combination with coupling the divider to outer cover 140. In one embodiment, divider 160 includes flanges 60*a*, 60*b* angled with respect to cover 140 to allow the divider to be attached to cover 140.

Divider 160 has a shield 150 coupled thereto (by welding, spot welding, bolting, riveting, or other suitable means) which includes a cut-out 162 sufficient to allow mating with the inner mating sleeve 170. Shield 150 has an arcuate shape best depicted in phantom in FIGS. 7 and 8, the radius of the arc forming the shield closely matching the radius of the semi-circular shape of the outer housing 140. It should be recognized that the shield 150 may have other configurations. For example, the shield my have a triangular, square, rectangular, or trapezoidal cross-section (when viewed from the top or bottom), or may even comprise a flat plate bisecting a portion of the curved outer cover 140.

A direct vent pipe coupling is formed by an outer mating sleeve 180 and inner mating sleeve 170, which secure the two duct, direct vent pipe (not shown) to the vent cap 100. Outer sleeve 180 may be welded or otherwise secured to back plate 110. Inner sleeve 170 is secured in divider 160 and is positioned within outer sleeve 180. Alternatively, spacers may be provided between inner sleeve 170 and outer sleeve 180 to secure the sleeves to each other. The outer mounting sleeve 180 is designed to couple to a direct vent pipe in a well-known manner. For example, the outer sleeve may include ridges to allow the pipe coupling to engage a twist lock coupling such as that commercially available from Simpson Dura-Vent Corporation, which is a bayonet-style lock allowing one end of the pipe to be inserted into the outer pipe 180 and twisted into place to secure it therein.

The inner sleeve 170 and outer sleeve 180 are sized relative to the size of the connection to be made. For example, in one embodiment where the cap is to be used with 4×6⅝" pipe the inner sleeve 170 will have a diameter of about 4" and the cut-out 162 a diameter of 4 1/16 inches. Where the inner sleeve is to be press fit into the cut-out 162, the cut-out may be made to a diameter of about 3 11/32," slots formed in the cut out and the interior sides bent to form flanges surrounding the sleeve 170 when inserted into the bore 162. Likewise, where the outer liner 180 has a 6⅝" inch diameter, the cut out will have a 6 23/32" diameter. If the outer liner 180 is designed to be press-fit into backing plate 110, bore 112 may be cut to a diameter of 5 11/32" and the interior sides bent back so that the sleeve 180 is secured therein.

As illustrated in FIGS. 2, 7 and 8, the inner pipe 170 has an end portion 172 which extends to a plane formed by divider 160. A top cap 120 and bottom cap 130 cover the area defined between the top and bottom of outer cover 140 and mounting plate 110, enclosing the shield 150, divider 160 and pipe coupling. Top cover includes holes 122, 123 and bottom cap 130 includes holes 132, 133 which, in this embodiment, are covered by mesh screens 124, 134, respectively. Holes 122 and 132 are positioned, as illustrated in FIGS. 7 and 8, between the shield 150 and divider 160. Holes 123 and 133 are positioned over and under the region between backing plate 110 and divider 160.

Figure 6:
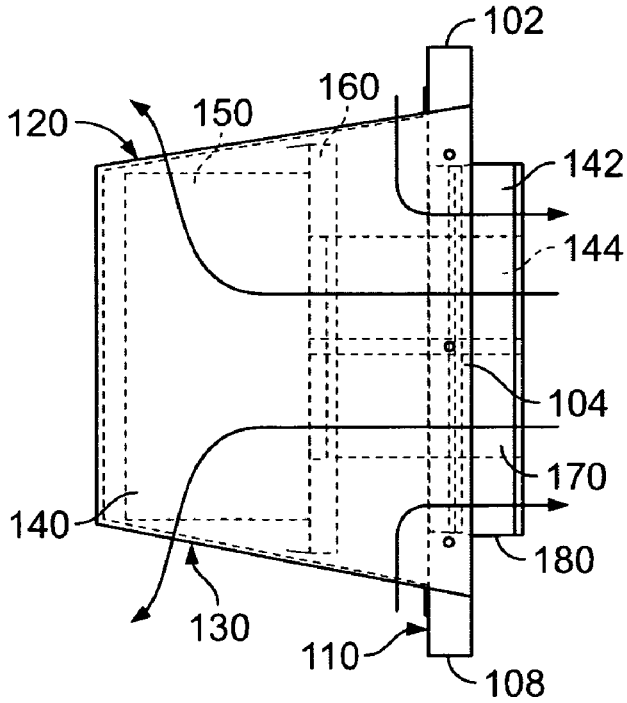
FIG. 6 is a side view of the first embodiment of the vent cap of the present invention.

As illustrated in FIG. 6, holes 122, 132 comprise inlet holes while holes 123,133 comprise outlet holes. In-flow air will be retrieved between vent holes 122 and 132 into an inlet region formed between covers 120, 130, divider 150 and back plate 110 into the outer duct 142. Exhaust area emanating from the combustible appliance in direct vent system will exit via the inner duct 144 to an exhaust region formed between the divider 160, shield 150, covers 120, 130 and exit out of holes 123, 133, respectively.

In cap 100, the inner sleeve 170 and outer sleeve 180 are mounted in the approximate center of backing plate 110. Likewise, the sleeves 170 and 180 are located at the approximate center of the inlet and exhaust regions of the cap 100 (as viewed in FIG. 4 or 5).

Vent cap 100 provides a number of advantages over the prior art. In particular, the external semi-circular housing 140 of the vent cap is shielded from excessive heat by use of the accurate interior shield 150. Likewise, the use of divider 160 inhibits intermixing of the gases in the exhaust area exiting from regions 123 and 133, and input air entering in region 122 and 132. Because of the outward circular shape of the outer housing 140, the vent cap is less resistant to adverse effects from wind or less likely to cause injuries to individuals who may encounter the vent cap 100 by accident. The ambient temperature of the outer cover 140 is reduced due to the presence of shield 150 therein. Likewise, the absence of rough edge at the exterior cap 140 prevents injury to individuals who may strike the vent cap inadvertently, reducing the risk of receiving serious injury.

In a system where a so called 4×6⅝" direct vent pipe is used to vent the appliance, the area provided by the interior pipe is about 12.56 square inches, the outer pipe about 21.91 square inches, and the area between the top and bottom openings in the cap about 30.94 square inches.

In the embodiment of FIG. 1, the area of borders 132, 134 is approximately 15.5 square inches, each. This provides a total of over 30 square inches of opening to allow flow in and out of the cap.

In yet another embodiment of the invention, the outer covers may be labeled with the word "hot" embossed into the outer metal cover to warn people close to the vent of the heat danger associated therewith.

FIGS. 9-16 illustrate a second embodiment of the vent cap in accordance with the present invention. Vent cap 200 is formed in a manner similar to that of vent cap 100 but includes an extended stem or "snorkel" portion 226 and three vent inlet/outlet regions. In this case, the exhaust region is vertically displaced from the vent pipe coupling (sleeves 270, 280), and the inlet region extends the length of the snorkel portion 226. These features make the cap advantageous for use in environments where the lower portion of a cap may be covered or otherwise, such as by snow creeping up the side of the dwelling.

Figure 10:
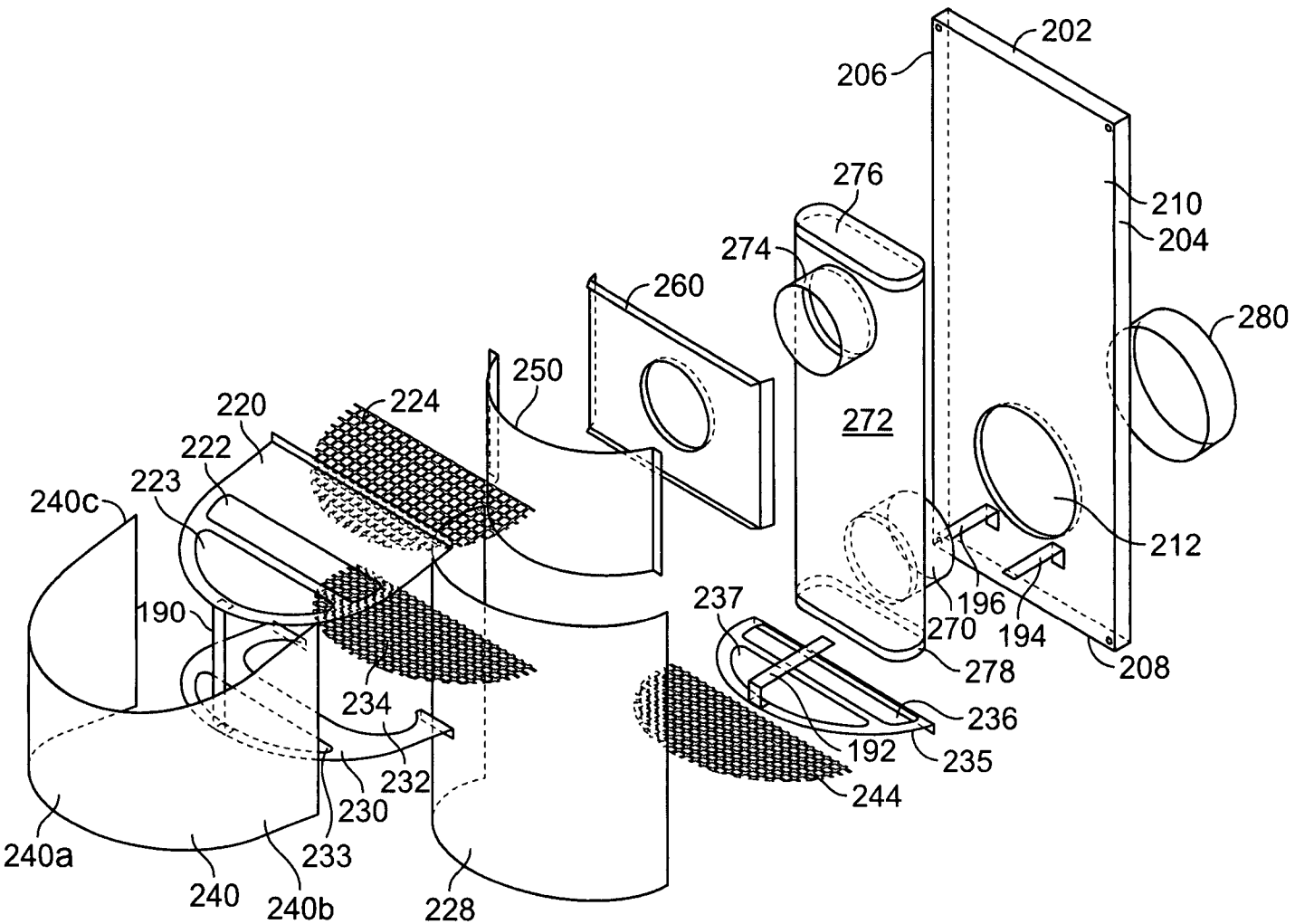
FIG. 10 is an exploded view of the components comprising the vent cap shown in FIG. 9.
Figure 11:
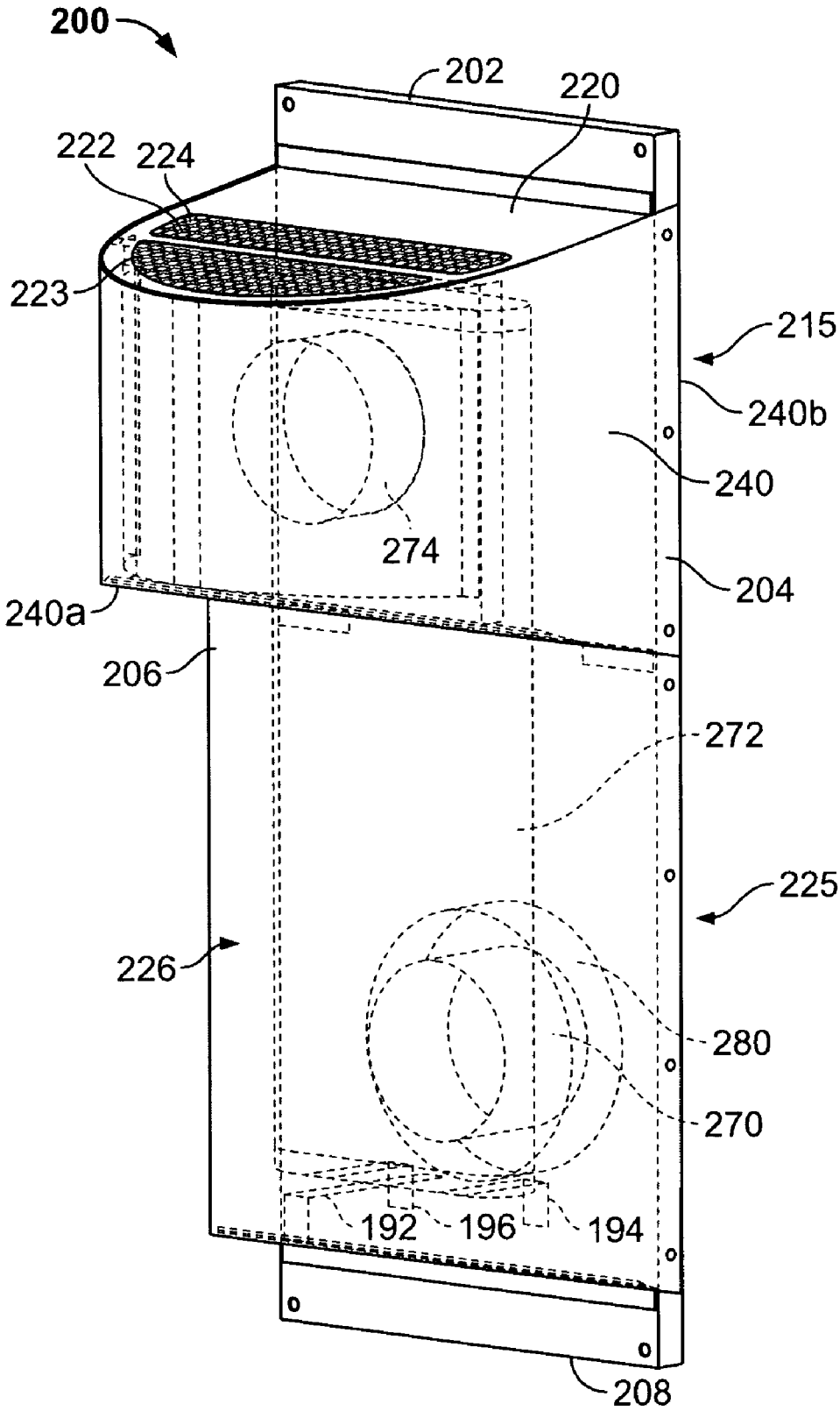
FIG. 11 is a second perspective view of the second embodiment of the vent cap of the present invention.
Figure 12:
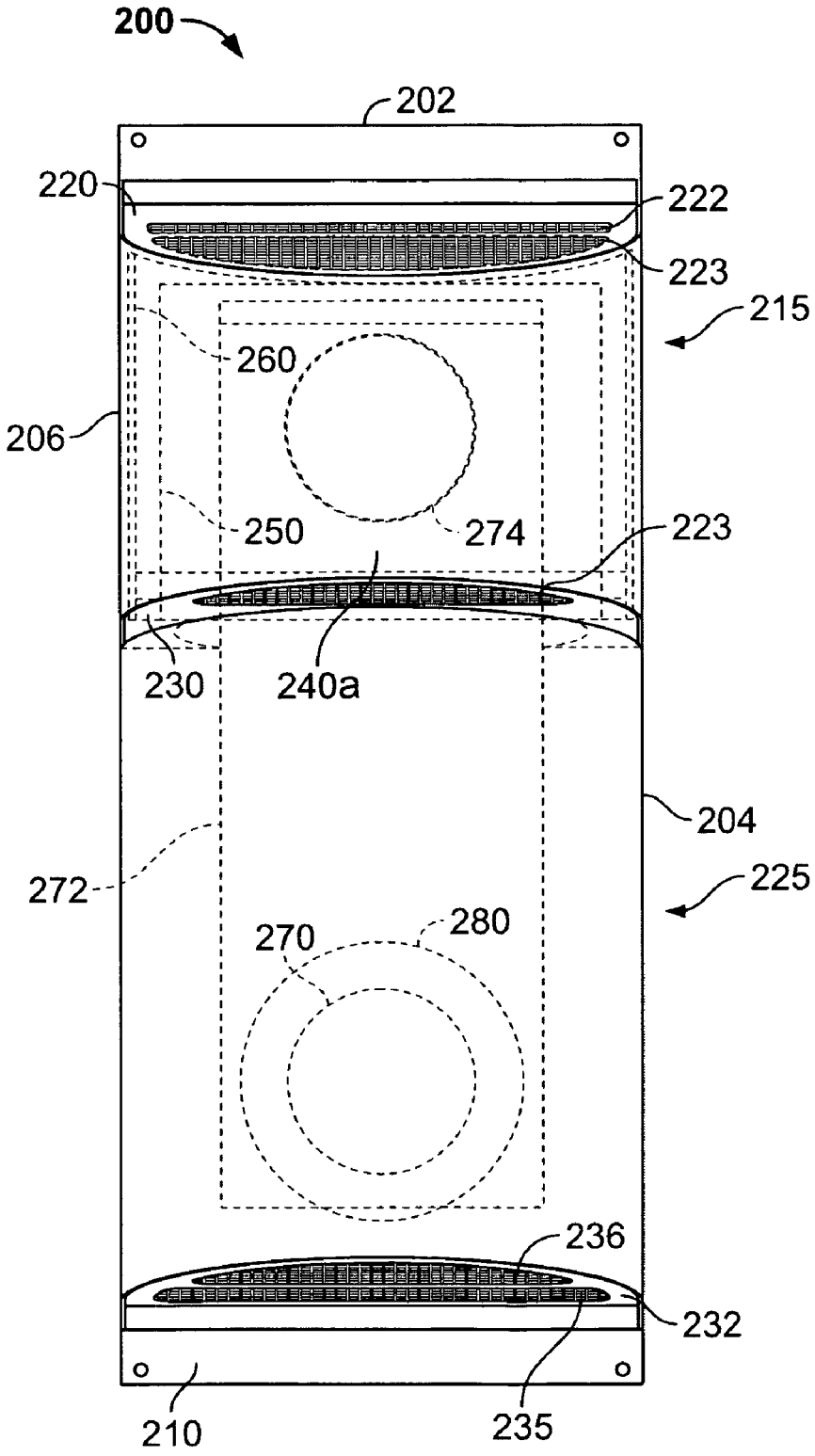
FIG. 12 is a front view of the second embodiment of the vent cap of the present invention.
Figure 13:
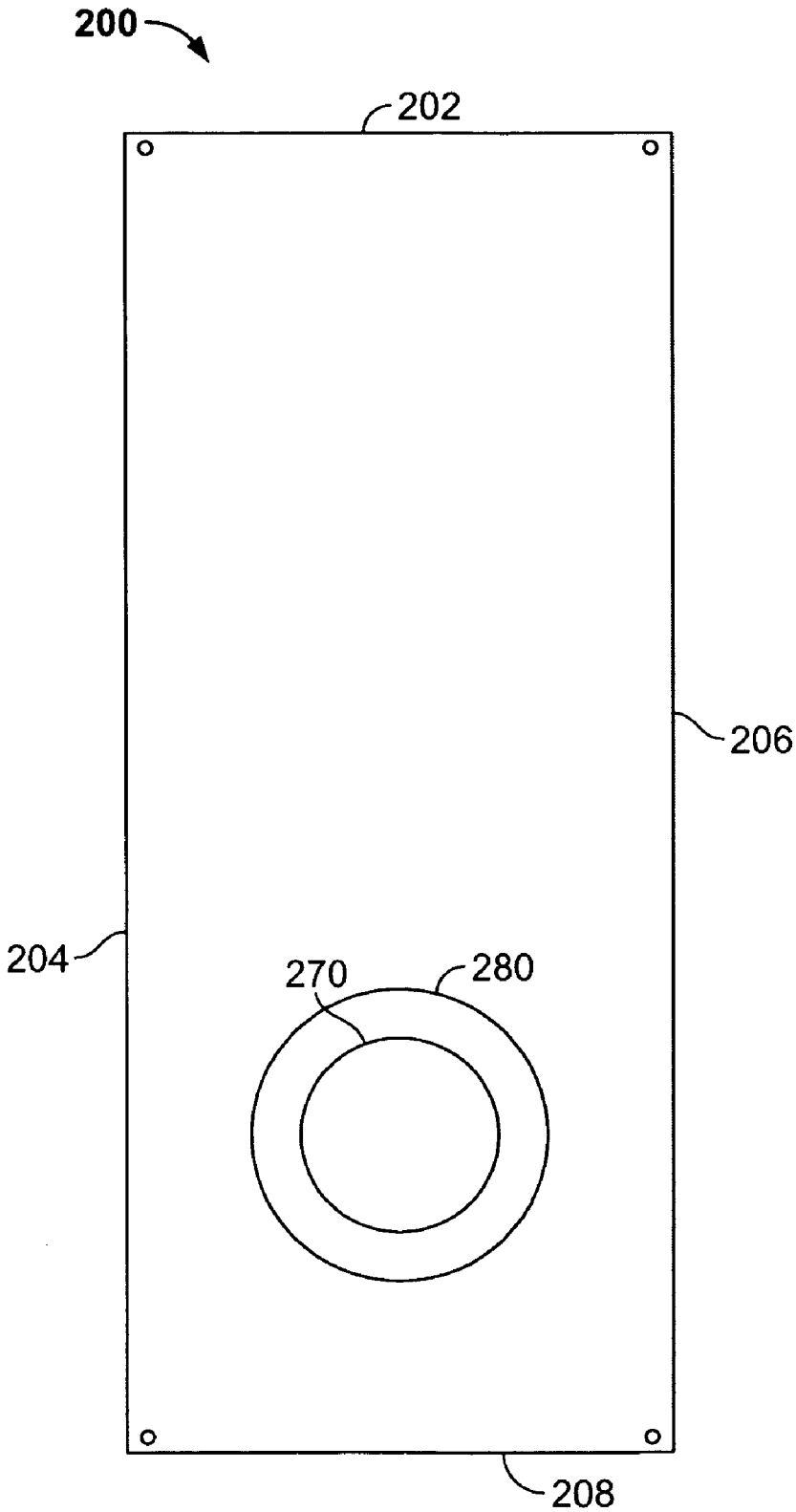
FIG. 13 is a rear view of the second embodiment of the vent cap of the present invention.
Figure 14:
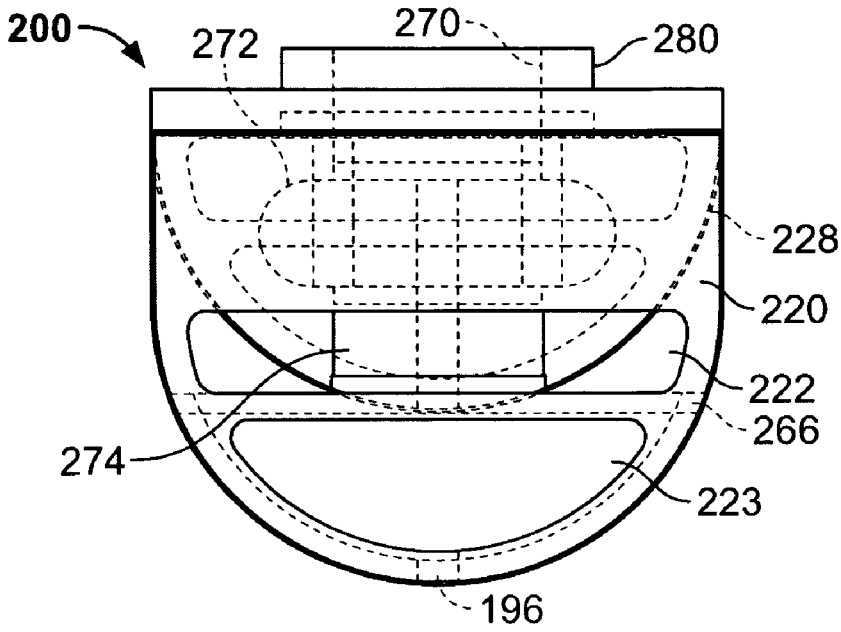
FIG. 14 is a top view of the second embodiment of the vent cap of the present invention.
Figure 15:
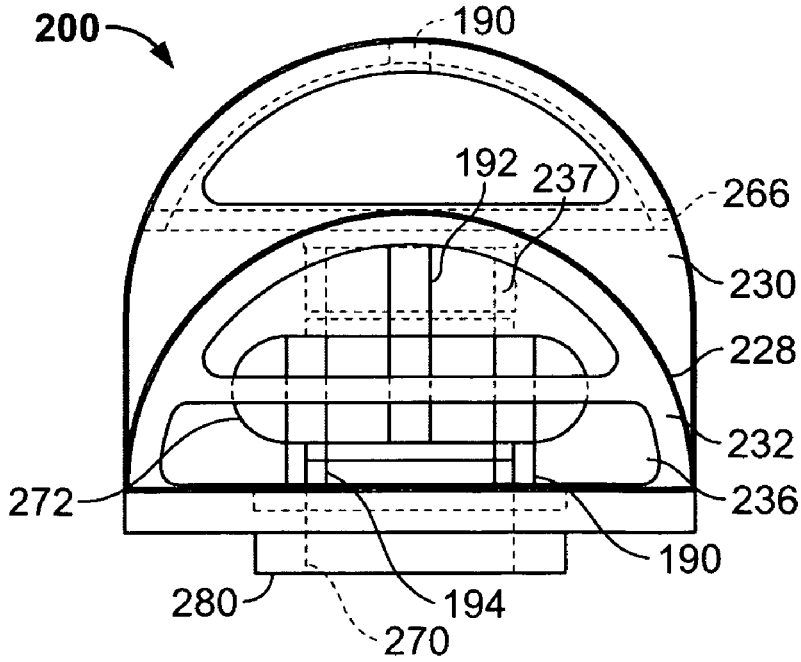
FIG. 15 is a bottom view of the second embodiment to the vent cap of the present invention.

Vent 200 includes an upper portion 215 which resembles the first embodiment of the vent pipe 100 of the present invention, and a lower portion 225. As illustrated in FIG. 10, a vertically oriented vent pipe stem 272 extends from a direct vent pipe coupling comprising inner sleeve 270 and outer sleeve 280. Inner sleeve 270 couples the exhaust portion of a two duct direct vent pipe (not shown) to the stem 272 of vent cap 200, while outer sleeve 280 couples the outer portion of the direct vent pipe to cap 200.

Backing plate 210 has a generally rectangular shape defined by shorter length top side 202 and bottom side 208, and longer left and right sides 206, 204. Where cap 200 is designed for use with 3×4⅝" direct vent pipe, backing plate 210 may have sides 202, 208 with a length of about 8 inches, and sides 206, 208 with a length of 24.86". Like backing plate 110, rectangular side flanges may be formed to define each edge 202, 204, 206, 208 and serve as support for mounting covers 240, 228 thereon. A cutout 212 is provided in backing plate 210 to which outer mounting ring 280 is secured by welding or other suitable means. Outer covers 240 and 228 are secured to backing plate 210 by welding, bolting, riveting, or other suitable means, and serve as structural support for various components of the cover 200, as described below. In the aforementioned 3×4⅝" pipe embodiment, cap 240 has edges 240*a,b* having a length of about 10" inches, while cover 228 has edges 228*a,b* having a length of about 12.85".

Upper portion 215 of vent cap 200 includes an outer semi-circular housing 240, interior shield 250, and divider 260 which function in a manner similar to those elements 140, 150 and 160 in the embodiment of FIG. 1. Divider 260 is secured to the interior of cover 240 by welding, bolting or riveting, and shield 250 secured to divider 260. An upper cap 220 and middle cap 230 are secured to backing plate 210 and to each other by a connector 190, again by welding, bolting or riveting. Upper cap 220 includes holes 222 and 223, which comprise generally inlet holes and outlet holes, respectively. Middle cover 230 includes holes 232 and 233. Hole 232 provides a space within step 226 for pipe 272. Hole 233 comprises an outlet hole. Outer cover 240 includes edges 240*b* and 240*c* and has an apex 240*a* which is shorter than edges 240*b,c*. Hence, like cap 100, the covers 220, 230 are angled downward toward the apex 240*a* of the cover at an angle of about 80 degrees relative to plate 210. Cover 228 is formed by a sheet of stainless steel having an angled top edge 228*a* and bottom edge 228*b* which allow the edges 228*a* to match the angle of cover 230 when cap 200 is assembled. Mesh screens 224, 234, 244 cover the inlet and outlet holes. (Note, these screens are not depicted in FIGS. 14 and 15 for clarity.)

Inner pipe 272 transports exhaust gases to the exhaust region formed between shield 250 and divider 260. In the embodiment shown in FIGS. 9-16, pipe 272 has an oblong cross-section defined between a first end 276 and a second end 278 of the pipe. Such a cross section is useful where one seeks to reduce the projection of the pipe away from the back plate 210. Pipe 272 is coupled to backing plate 210 by straps 194 and 194, and to divider 260 by a pipe coupling 274 which engages bore 262 in divider 260. Pipe stem 272 transfers exhaust gases from the vent pipe and coupling 270 vertically up the length of the region 225 to the exhaust bore 262. A second semi-circular cover 228 covers the lower region 225 of the vent cap 200. A bottom cap 235 is coupled to backing plate 210 and the bottom 278 with bottom cap screen 244 covers the base portion of the vent cap 200. Bottom cap 235 includes boxes 236 and 237, both of which act as intake vents for the cap 200.

Figure 16:
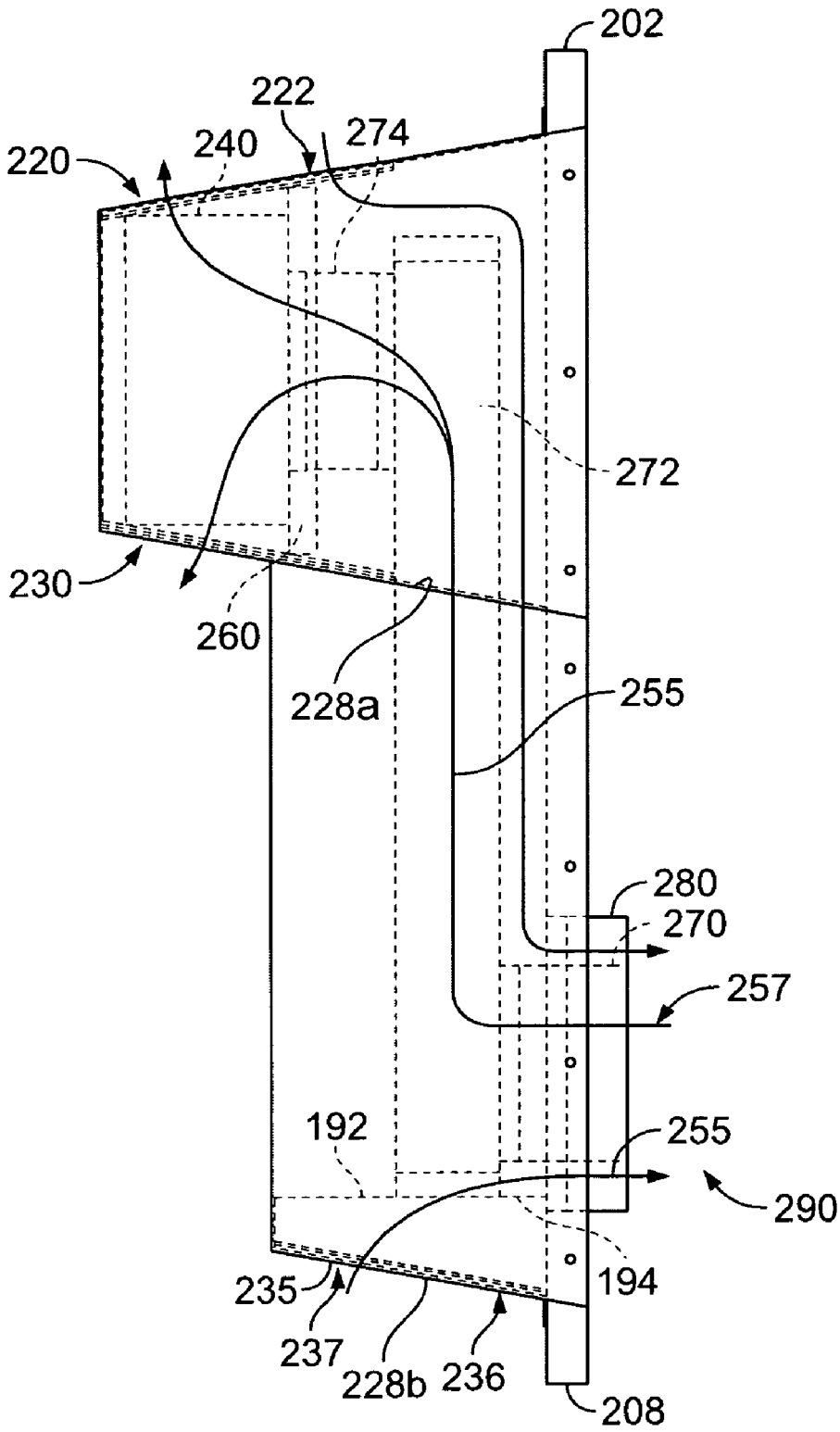
FIG. 16 is a side view of the second embodiment of the vent cap of the present invention.

FIG. 16 illustrates the flow path for air entering 255 and exiting 257 the vent cap 200. In cap 200, the exhaust region is formed between divider 260, shield 250 and cover 240, while the intake region is formed between cover 228, divider 260 and back plate 210. Three entry regions are provided for in-flow: region 234, 232, and 222. Outflow of combustible gases is displaced vertically from the exit point 290 of the dwelling. Air 257 (heated from the direct vent appliance) enters the inner liner, the inner pipe 272, the pipe coupling 274 and exits via holes 223 and 233 at the upper regions 215 of vent cap 200. As in the previous embodiment, exhaust gases are shielded from the intake points of the cap. In addition, vertical displacement of the exit gases relative to the exit point 257 (FIG. 16) from the dwelling provides advantages for dwellings in regions where weather or brush conditions might inhibit flow of gasses into or out of the cap, such as for example, in regions where a heavy snowfall occurs.

Again with respect to vent cap 200, the inner sleeve 270 and outer sleeve 280 are sized relative to the size of the direct vent pipe connection to be made. Likewise, the bore in shield 160 may be sized relative to the inner pipe specified above with respect to liner 170 and divider 160.

Figure 17:
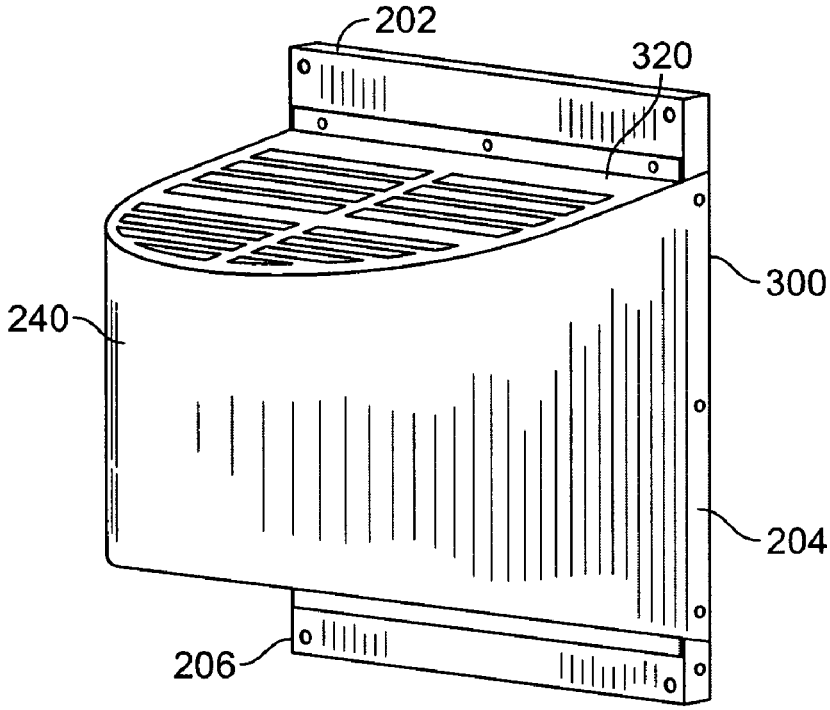
FIG. 17 is a perspective view of a first alternative top cover and bottom cover shown as used with the first embodiment of the vent cap of the present invention.
Figure 18:
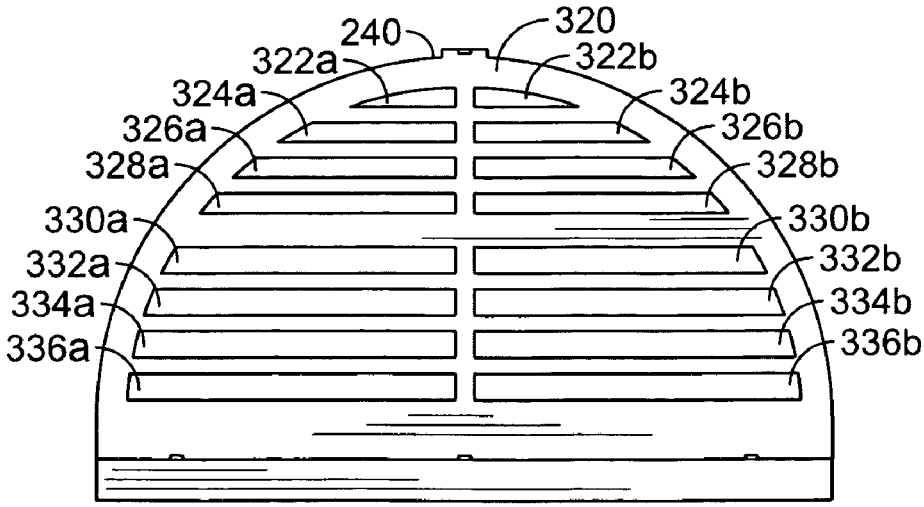
FIG. 18 is a top view of the first alternative top on bottom cover of the vent cap of the present invention.

FIGS. 17 and 18 illustrate an alternative cover 320 which may be utilized with either the embodiment shown in FIGS. 1-8 or the embodiment shown in FIGS. 9-16, or in combination with any embodiment shown herein. Vent cover 320 may be used in place of any of the vent covers 120, 130, 220, 230, 232 discussed above.

In this embodiment, slots are used to cover the intake and exhaust areas, rather than the large holes (such as, for example, holes 222, 223 illustrated above). In cover 320, a plurality of slots 322*a,b*, 324*a,b*, 326*a,b*, 328*a,b*, 330*a,b*, 332*a,b*, 334*a,b*, and 336*a,b* can take the place of holes 222, 223 or 232, 233. In FIG. 17 the top cap 320 is illustrated with respect to a vent cap 300 having configuration similar to vent cap 100. It will be readily understood that the configuration of the cap cover 320 may be directly substituted with either cap 100 or cap 200. The cap 320 can directly replace top cap 120 or bottom caps 130 or 232. For a middle vent cover 230, slots 330*a,b*, 332*a,b*, 334*a,b*, and 336*a,b* would be replaced with a bore similar to bore 232 and only slots 322*a,b*, 324*a,b*, 326*a,b*, 328*a,b*, used to replace bore 233. Likewise, for top cap 220, slots 330*a,b*, 332*a,b*, 334*a,b*, and 336*a,b* would be eliminated and only slots 322*a,b*, 324*a,b*, 326*a,b*, 328*a,b*, used.

Figure 19:
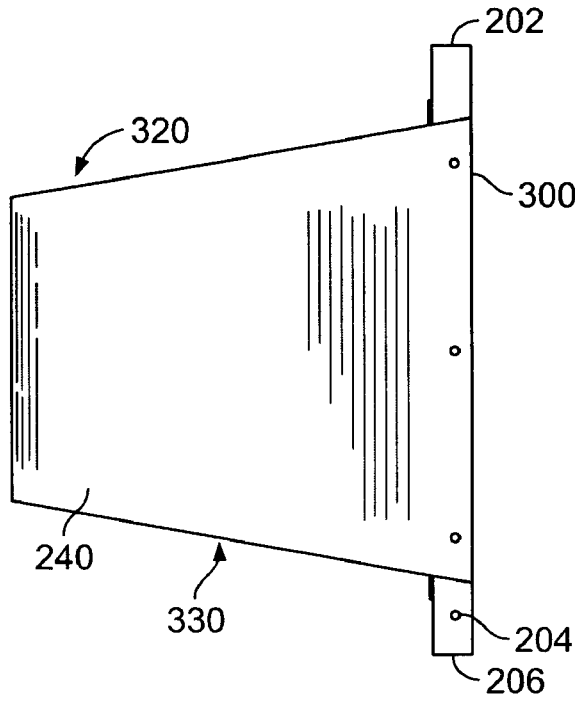
FIG. 19 is a side view of the first alternative top and bottom covers on the first embodiment of the vent cap of the present invention.

As illustrated in FIGS. 18 and 19, slots are formed by removing metal slats by cutting into a flat piece of stainless steel or sheet metal. A mesh cover similar to covers 224, 234 may be optionally utilized under the slots. The size of the resulting slots is typically small enough to allow sufficient air flow to meet the needs of the direct vents, but small enough to prevent combustible or other materials from entering the vent cap. In one embodiment, the total square area of the slots is on the order of 3 $inch^2$.

Figure 20:
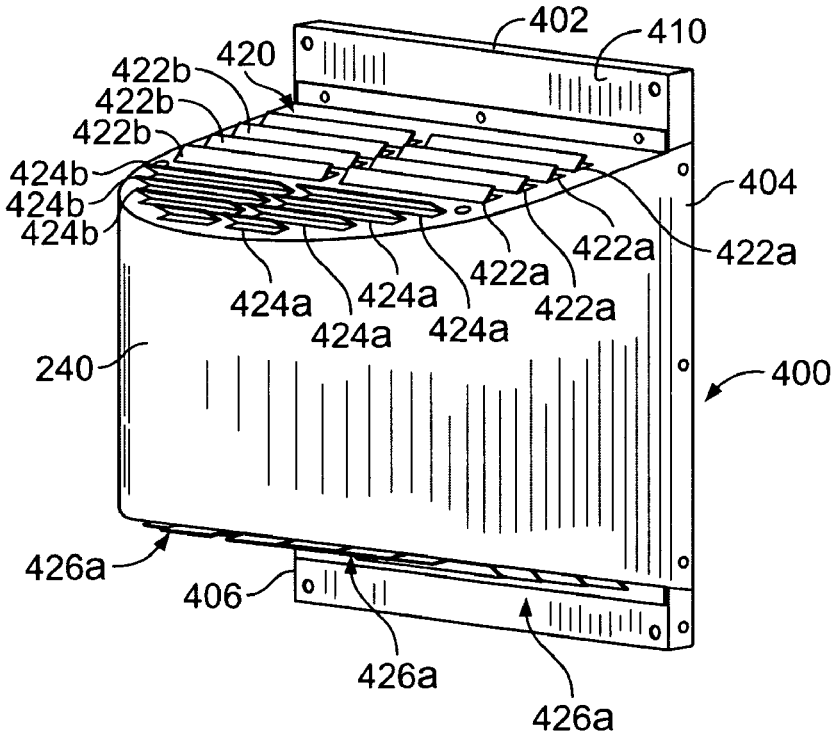
FIG. 20 is a perspective view of a second alternative top and bottom covers utilized in accordance with the present invention.
Figure 21:
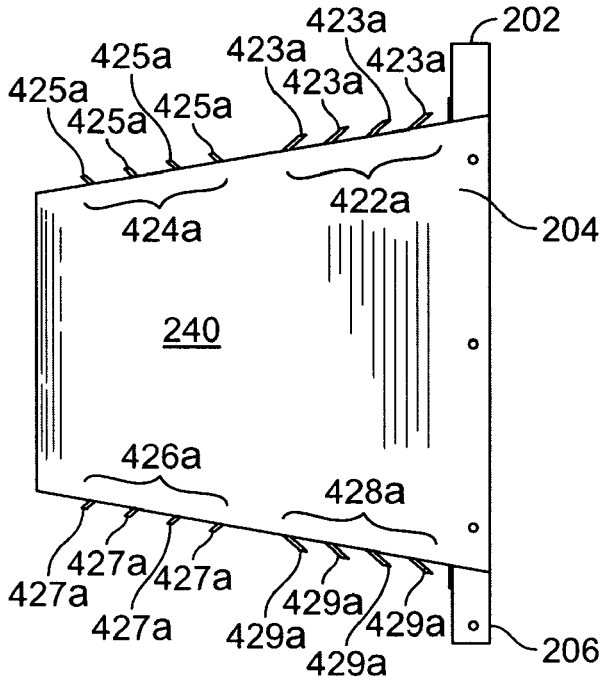
FIG. 21 is a side view of the second alternative top and bottom covers utilized in accordance with the present invention.
Figure 22:
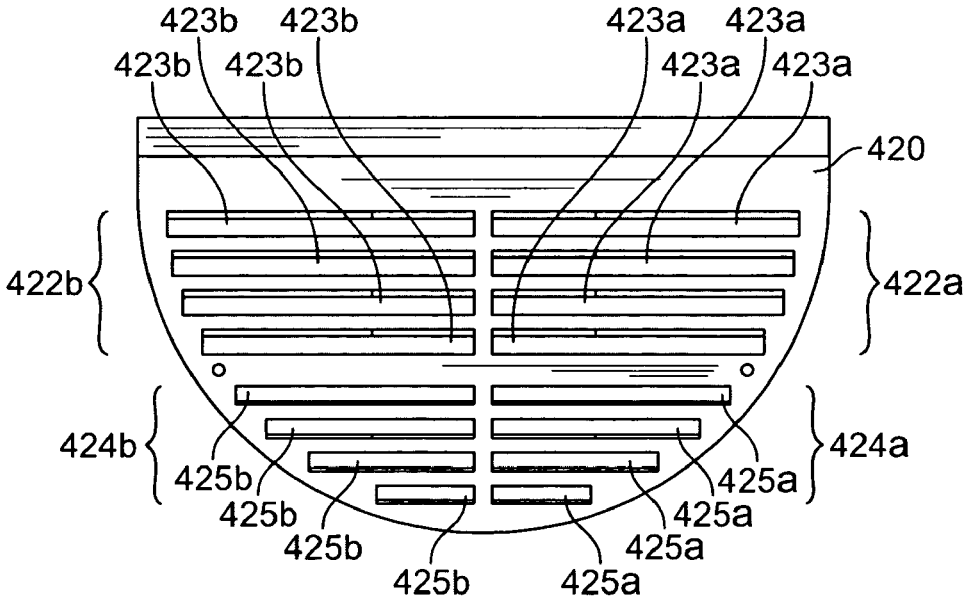
FIG. 22 is a top view of the second alternative top or bottom cover.

FIGS. 20, 21, and 22 illustrate a second alternative cap cover 420 which, in suitable variants, may be utilized as an upper vent cover 120, 220, middle vent cover 230 or lower vent cover 130, 232 in either of the vent caps 100, 200. For purposes of illustration, vent cover 420 is illustrated with respect to a vent cap 400 having a configuration equivalent to vent cap 100.

Figure 23:
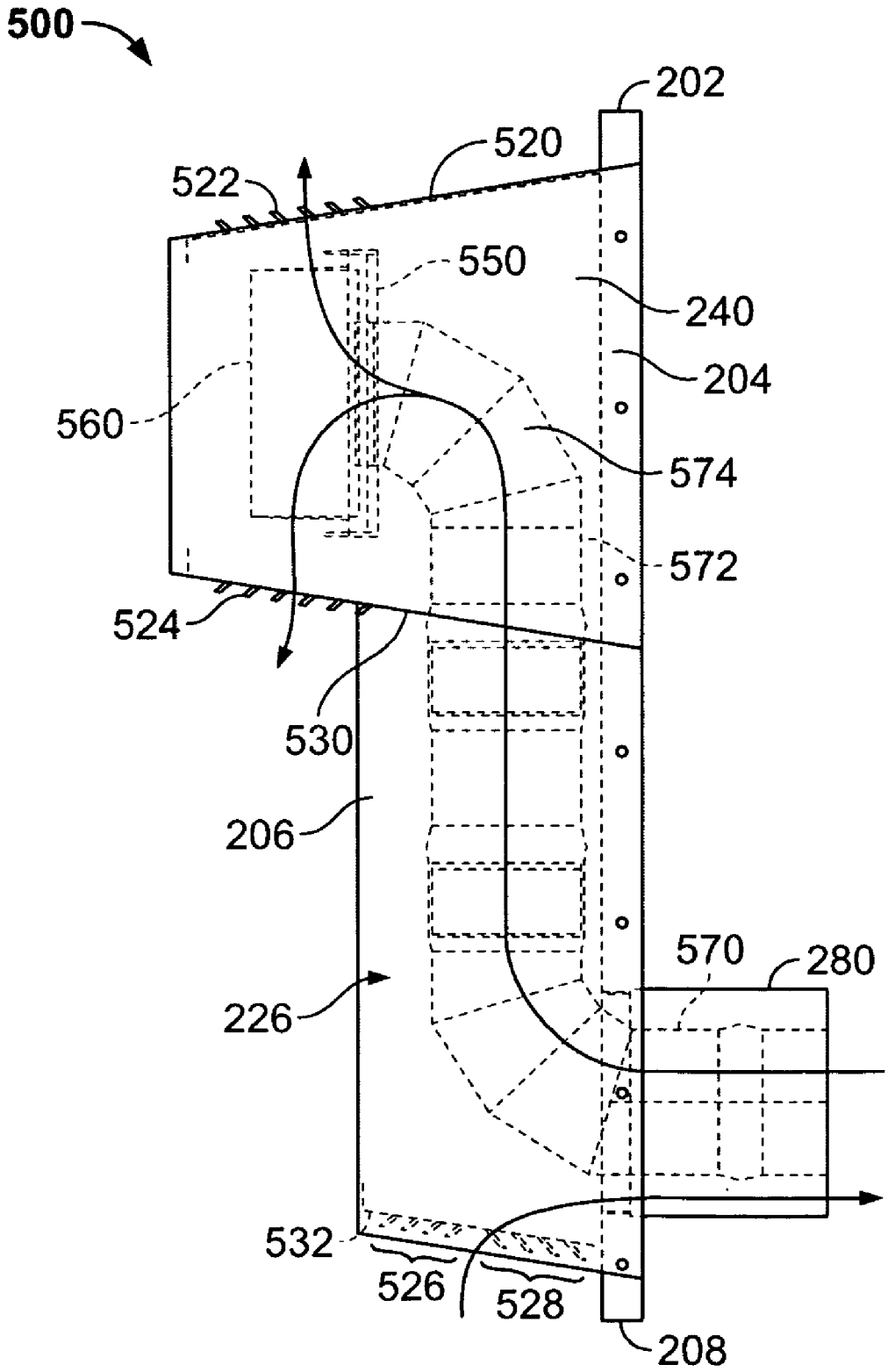
FIG. 23 is a side view of a third embodiment of the vent cap in accordance with the present invention.

The vent cover 420 includes a first plurality of slots 422*a*, 422*b*, each slot having an angled flange 423*a*, 423*b* respectively which, as illustrated in FIG. 21, is angled toward the backing plate 410 of, for example, the vent cap 400. The second plurality of vents 424*a*, 424*b* each has angled flange 425*a*, 425*b* angled away from the mounting plate 410. In this configuration the exhaust gases exiting the "forward-facing" plurality of slots 424*a*, 42*b* are generally urged away from the intake slots 422*a*, 428*a*, to help further prevent mixing of combustion and intake gases, thereby further improving the efficiency of the vent cap relative to the prior art. As discussed above with respect to cover 320, various embodiments of cap 420 may be utilized to replace the covers 120, 220, middle vent cover 230 or lower vent cover 130, 232. The cover 420 can directly replace top cap 120 or bottom caps 130 or 232. For a middle vent cover 230, slots 422*a*, 422*b* would be replaced with a bore similar to bore 232, and only slots 424*a* and 424*b*, used to replace bore 233. Likewise, for top cap 220, slots 422*a*, 422*b* would be eliminated and only slots 424*a* and 424*b* used This latter embodiment is shown in another alternative embodiment—vent cap 500—shown in FIG. 23, FIG. 23 illustrates vent cap 500 having a configuration similar to that of vent cap 200. Reference numbers in common with the vent cap 200 indicate like parts with vent cap 200. Vent cap 500 includes a top cover 520 having a configuration similar to vent cover 420 but with slots 422*a*, 422*b* eliminated, so only forward facing flanged slots 522 are used. Likewise, middle cap 530 includes forward facing flanged slots 524 and a bore (not shown) which allows interior pipe 574 to couple to divider 550.

A lower vent cap 530 has a configuration equivalent to vent cover 420 with a plurality of forward facing slots 526 (equivalent to slots 424*a*, 424*b*) and rearward facing slots 528 (equivalent to slots 422*a*, 422*b*).

Vent cap 500 also incorporates the use of a rounded cross-section, standard direct vent coupling pipe 574 in place of the oblong pipe 272 of FIGS. 9-16. This allows the re-use of existing parts, eliminating the need to fabricate a special part for the vent cap 500. Again, because exhaust gases exit the center pipe 574, these will be urged away from the intake region of the vent cap 500.

Figure 24:
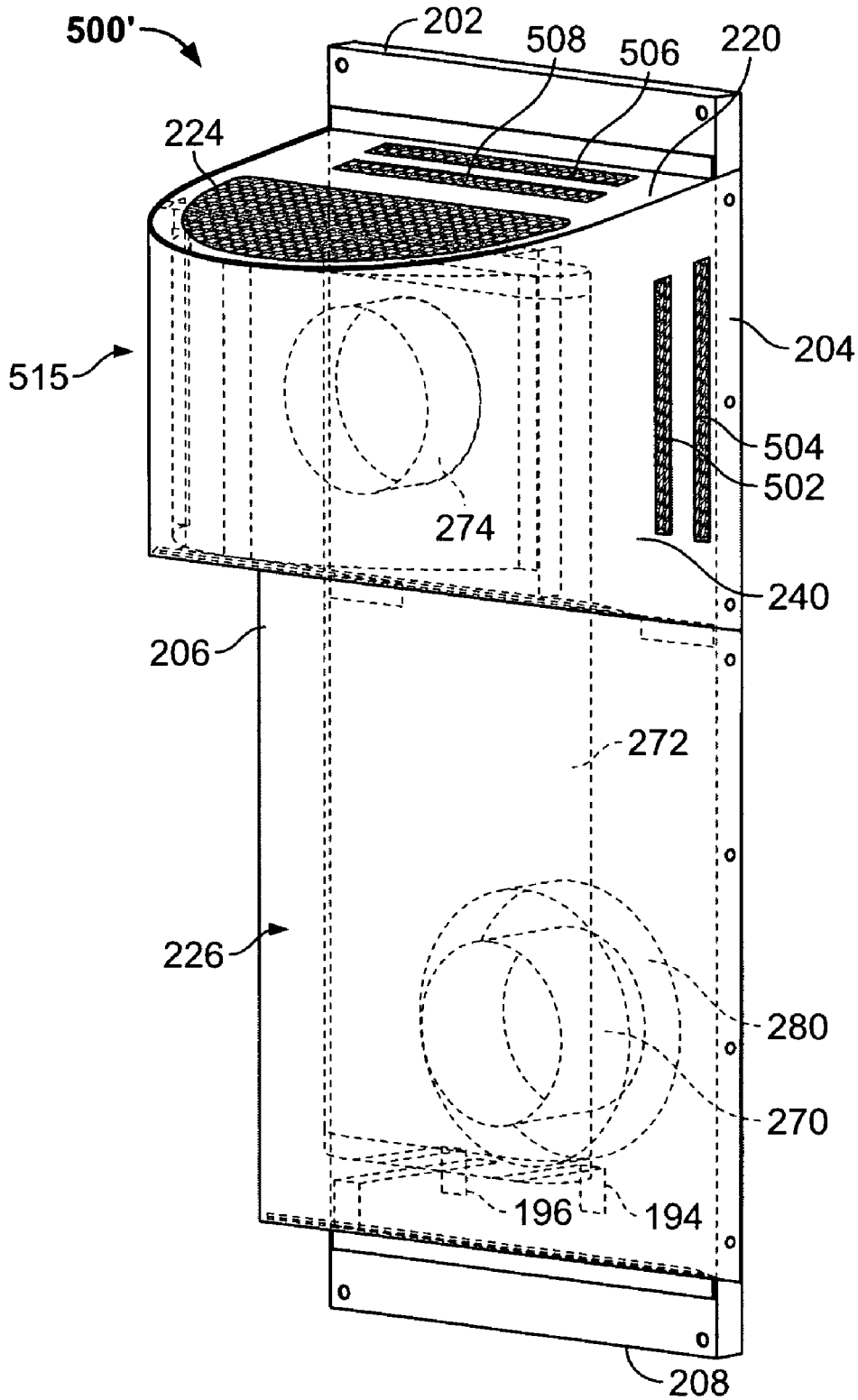
FIG. 24 is a perspective view of a fourth embodiment of the vent cap in accordance with the present invention.
Figure 27:
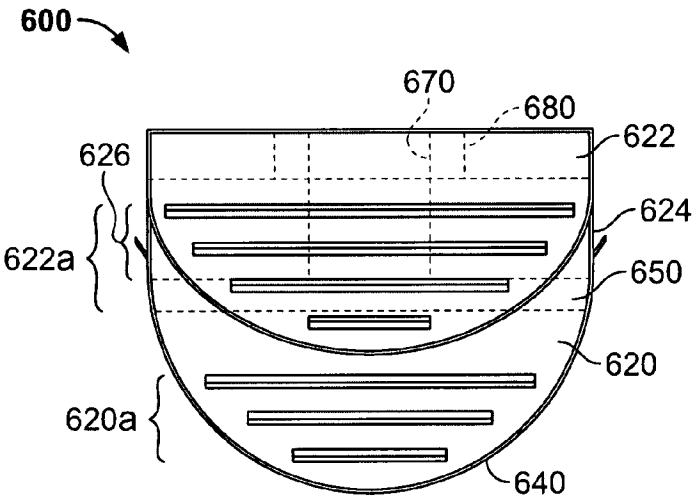
FIG. 27 is a top view of the fifth embodiment of the vent cap of the present invention.
Figure 25:
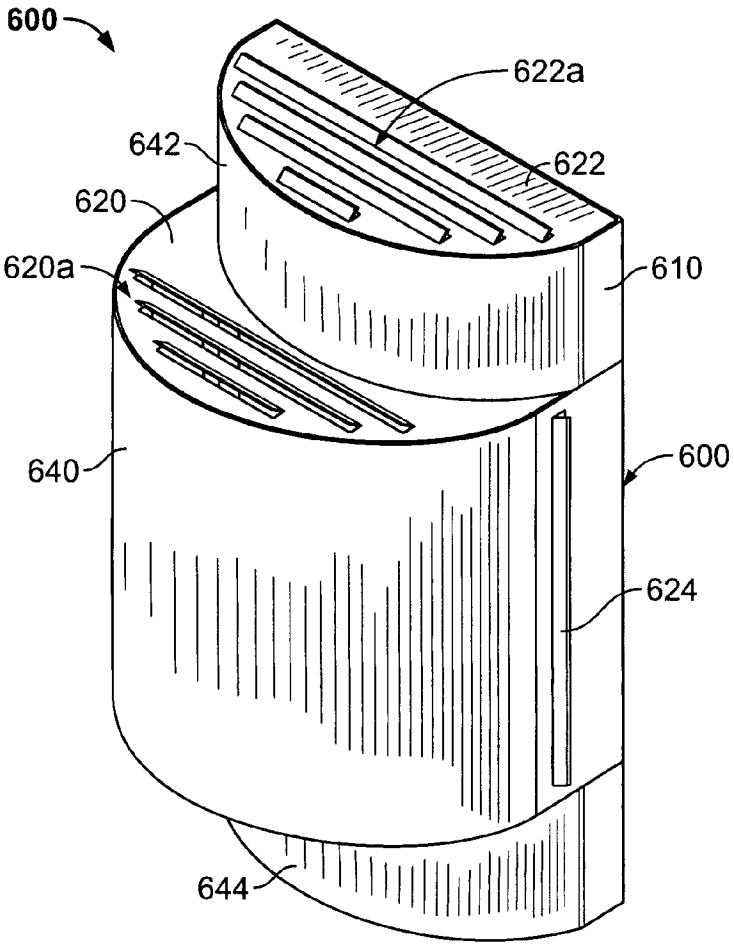
FIG. 25 is a perspective view of a fifth embodiment of the vent cap formed in accordance with the present invention.

A further alternative of the present invention is shown in FIG. 24. Vent cap 500' has a configuration equivalent to that of the vent cap 200 of FIGS. 9-16. In vent cap 500', additional intake slots 502, 504, 506, 508 are provided in the upper region 515 and top cap 520 of this device. This allows additional intake gases and fresh air to enter the outer vent stem and helps improve efficiency where the bottom cap 230 may encounter heavy snowfalls covering up the intake area in the lower cover 232. Exit gases may continue to exit the upper portion of the stem, and increased area is provided in the upper region 515 for intake gases to enter the upper portion of the stem during periods when snowfall covers the lower portion of the stem 630. As should be readily understood, any of the various vent caps discussed herein may be utilized with this embodiment of the cap 500.

Yet another configuration of the vent cap of the present invention is shown in FIGS. 25-29. Vent cap 600 includes steel backing plate 610 having a top-side 602, a left-side 606, a right-side 604, and a bottom-side 608. Left and right sides may have a length of about 16" for a 4×6⅝" pipe cap. An outer cover 640 having a semi-circular cross-section is coupled by welding, bolting or riveting cover 640 to back plate 610. Cover 640 serves as structural support for a divider 660. In this embodiment, the apex of cap 640 is equivalent in length to its sides. Additional outer covers 642 and 644 are likewise secured to back plate 610. Divider 660 is coupled to the outer cover 640 by welding, by press fitting the sleeve into the bore, or by other suitable means. Divider 660 has a shield 650 coupled thereto (by welding, spot welding, bolting, riveting, or other suitable means) and includes a cut-out 662 sufficient to allow mating with the inner mating sleeve 670, the radius of the arc forming the shield closely matching the radius of the semi-circular shape of the outer housing 640.

A direct vent pipe coupling comprises an outer mating sleeve 180 and inner mating sleeve 670 secure the two duct direct vent pipe (not shown) to the vent cap 600. Outer sleeve 680 may be welded or otherwise secured to back plate 610. In another alternative, inner sleeve 670 is positioned within outer sleeve 180 and is secured to divider 660. The outer mounting sleeve is designed to couple to a direct vent pipe in a well-known manner.

Figure 26:
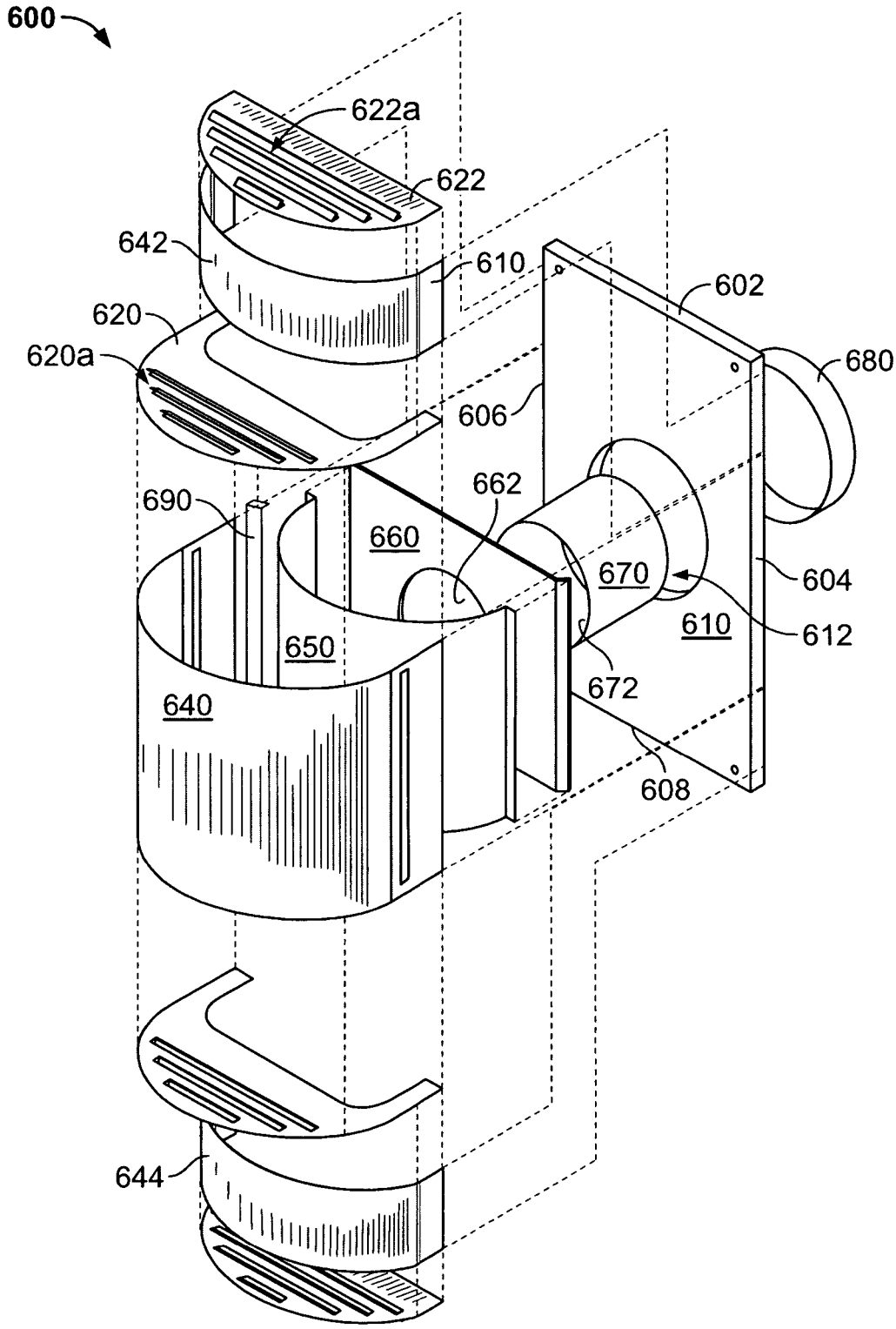
FIG. 26 is an exploded view of the fifth embodiment of the vent cap formed in accordance with the present invention.
Figure 29:
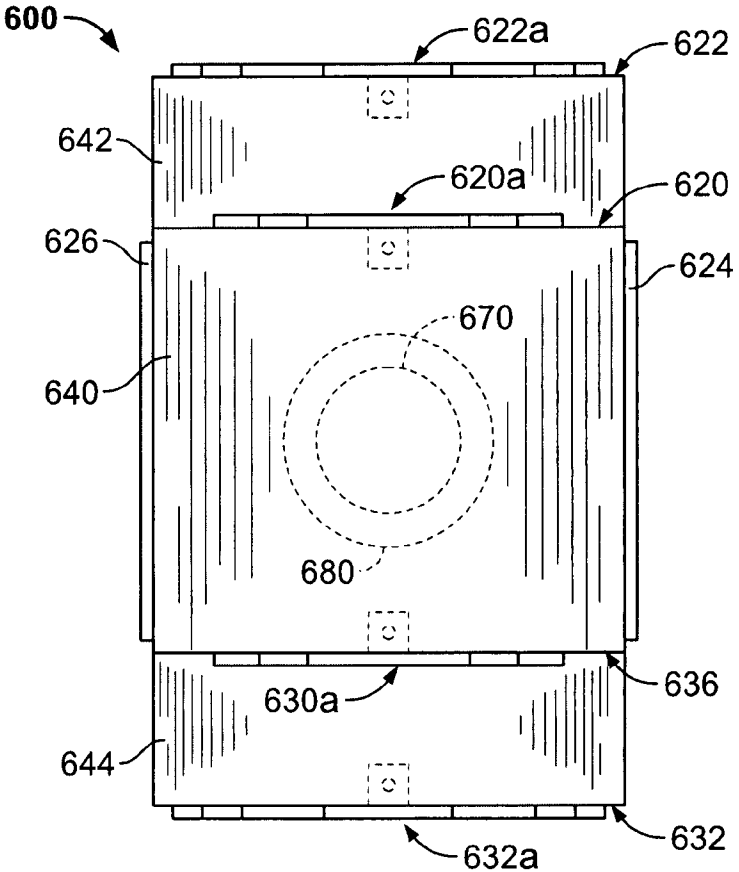
FIG. 29 is a side view of the fifth embodiment of the vent cap in accordance with the present invention.
Figure 28:
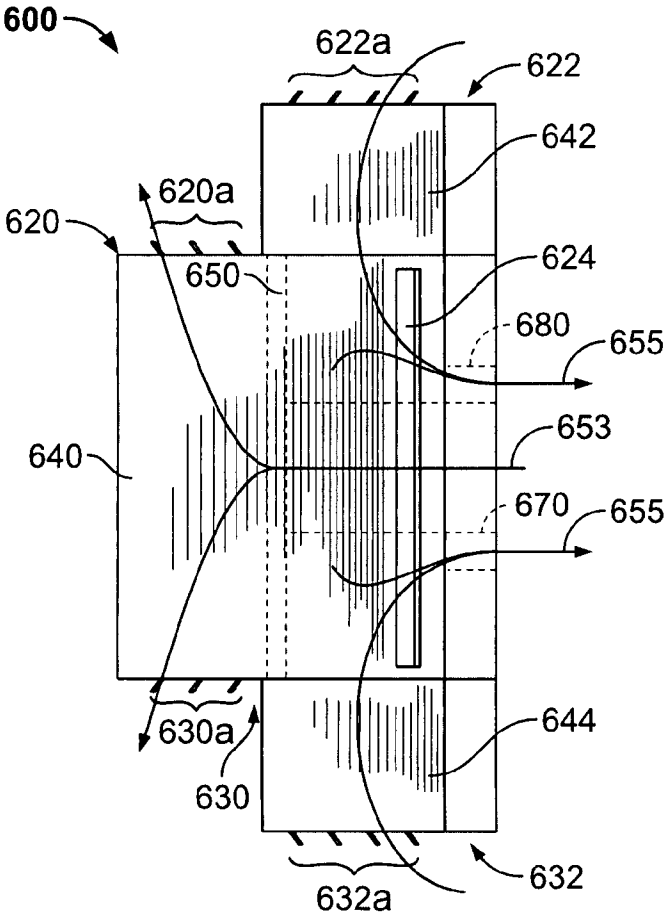
FIG. 28 is a front view of the fifth embodiment of the vent cap of the present invention.

The inner liner and outer liner are sized relative to the size of the connection to be made. As illustrated in FIG. 26, the inner pipe 670 has an end portion 672 which extends to a plane parallel with the plane formed by divider 660. A top cap 620 and bottom cap 630 cover the area defined between the top and bottom of outer cover 640 and shield 660, forming an exhaust region enclosing the shield 650, divider 660 and pipe coupling. The top cover 622 and bottom cover 632 cover the area defined between the shield 660 and backing plate 610, forming an intake air region. Top cover 620 and bottom cover 630 include a plurality of slots with "forward facing" flanges 620*a*, 630*a*, while top cap 622 and bottom cap 632 includes a plurality of slots 622*a*, 632*a* with rearward facing flanges In-flow air 665 will be retrieved between vent holes 622*a* and 632*a*, and side vents 624, 626 into the outer duct between the inner liner 670 and outer sleeve 680 for the intake of the direct vent pipe. Exhaust gases 653 emanating from the combustible appliance in direct vent system will exit via the inner duct 644 to the region between the divider 660 and shield 650 and exit the duct out of holes 620*a*, 630*a*, respectively.

Additional intake side vents 624, 626 allow additional inflow air to be received in the intake region.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A vent cap for a direct vent system, the cap comprising:

a base plate having a top, a bottom, a first side, a second side and an opening for receiving a two duct direct vent pipe having an inner pipe communicating with an outlet opening of the yent cap and an outer pipe communicating with an inlet opening of the vent cap, said base plate opening sized in correspondence with the outer pipe;

a semicircular outer housing secured to the base plate, the semicircular outer housing having a first edge attached to the first side of the base plate and a second edge attached to the second side of the base plate the first and second edges having a first height, the semicircular outer housing having an apex with a second height less than the first height;

semicircular a top cover and a semicircular bottom cover, the top cover positioned at a top side of the semicircular outer housing, the top cover having a top outlet aperture in communication with the outlet opening and a top inlet aperture in communication with the inlet opening, the bottom cover positioned at a bottom side of the semicircular outer housing, the bottom cover having a bottom outlet aperture in communication with the outlet opening and a bottom inlet aperture in communication with the inlet opening the apex of the semicircular outer housing causing the top cover and the bottom cover to be angled with respect to the base plate;

a divider coupled between the outer housing and the base plate, the divider having an opening aligned with the base plate opening and sized in correspondence with the inner pipe, and forming an exhaust region between the outer housing and the divider and an inlet region between the divider and the base plate the exhaust region in fluid communication with the outlet opening and the inlet region in fluid communication with the inlet opening;

an outer sleeve for coupling the outer pipe to the base plate opening such that the outer sleeve communicates with the inlet region;

an inner sleeve positioned between the divider and the base plate, wherein said inner sleeve couples the inner pipe to the divider opening such that the inner sleeve communicates with the exhaust region; and a heat shield positioned adjacent to the divider and in the exhaust region between the outer housing and the divider, the heat shield having a semicircular shape and directly coupled to the divider.

2. The vent cap of claim 1 wherein the heat shield has an arcuate shape generally matching a cross-sectional shape of the semicircular outer housing.

3. The vent cap of claim 1 wherein the inner sleeve and outer sleeve are mounted in the approximate center of the exhaust region and inlet region, respectively.

4. The vent cap of claim 1 wherein the vent cap includes an upper region including the semicircular outer housing, the heat shield and the divider defining the exhaust region and a lower region including a portion of the inlet region, the exhaust region vertically displaced from the lower region.

5. The vent cap of claim 4 wherein the inner sleeve and outer sleeve are positioned in the lower region of the vent cap and vertically displaced from the exhaust region such that exhaust gases are transferred vertically from a direct vent pipe coupling including the inner sleeve and the outer sleeve via the opening of the divider to the exhaust region.

6. The vent cap of claim 4 further including a second outer cover coupled to the base plate positioned adjacent to the first semicircular outer housing, defining said lower region.

7. The vent cap of claim 6 wherein the second outer cover includes at least a first slot and a second slot.

8. The vent cap of claim 1 wherein each said top cover and said bottom cover includes a first hole and a second hole, each said first hole positioned in correspondence with the exhaust region, each said second hole positioned in correspondence with the inlet region.

9. The vent cap of claim 1 wherein each said top cover and said bottom cover includes a first plurality of slots and a second plurality of slots, each said first plurality of slots positioned in correspondence with the exhaust region, each said second plurality of slots positioned in correspondence with the inlet region.

10. The vent cap of claim 9 wherein each said slot includes an angled flange positioned over the slot.

11. The vent cap of claim 10 wherein each of said plurality of slots has a first side and a second side, said first plurality of slots includes at least one angled flange positioned at the first side of the slot and angled in a first direction; and said second plurality of slots includes at least one angled flange positioned at the first side of the slot and angled in a second direction.

12. A vent cap for a direct vent system, the cap comprising:

a backing plate having, a top, a bottom, a first side and a second side and an opening for receiving a two duct direct vent pipe having an inner pipe communicating with an outlet opening of the vent cap and an outer pipe communicating with an inlet opening of the vent cap, said backing plate opening sized in correspondence with the outer pipe;

a first semicircular outer housing secured to a first vertical portion of the backing plate between the top and the bottom of the backing plate the first semicircular outer housing having a first edge attached to the first side of the backing plate and a second edge attached to the second side of the backing plate, the first and second edges having a first height, the first semicircular outer housing having an apex with a second height less than the first height;

a second semicircular outer housing secured to a second vertical portion of the backing plate between the top and the bottom of the backing plate a top cover and a middle cover, the top cover positioned at a top side of the semicircular outer housing the top cover having a top outlet aperture in communication with the outlet opening and a top inlet aperture in communication with the inlet opening, the middle cover positioned at a bottom side of the semicircular outer housing, the middle cover having a middle outlet aperture in communication with the outlet opening and a middle inlet aperture in communication with the inlet opening, the apex of the first semicircular outer housing causing the top cover and the middle cover to be angled with respect to the backing plate;

a divider coupled between the first semicircular outer housing and the backing plate the exhaust region in fluid communication with the outlet opening and the inlet region in fluid communication with the inlet opening, the divider having an opening and forming an exhaust region between the first semicircular outer housing and the divider and an inlet region between the divider and the backing plate;

a heat shield having a semicircular shape and positioned within the first semicircular outer housing within the exhaust region adjacent to an exhaust port, between the exhaust port and the first semicircular outer housing, wherein the heat shield is directly coupled to the divider;

a direct vent pipe coupling in the second vertical portion of the backing plate such that the exhaust region is vertically displaced from the direct vent pipe coupling, the direct vent pipe coupling including an inner sleeve and an outer sleeve;

a vent pipe stem positioned in the first semicircular outer housing and the second semicircular outer housing and between the divider and the backing plate, the vent pipe stem having a first end coupled to the direct vent pipe coupling and a second end coupled to the divider to form the exhaust port, the vent pipe stem extending vertically from the first end to the second end, thereby transferring exhaust gases vertically from the direct vent pipe coupling via the exhaust port to the opening of the divider.

13. The vent cap of claim 12 wherein the heat shield has an arcuate shape generally matching a cross-sectional shape of the semicircular outer housing.

14. The vent cap of claim 12 wherein the inner sleeve and the outer sleeve each respectively engageable with inner pipe and an outer pipe of direct vent pipe.

15. The vent cap of claim 14 wherein the inner sleeve is coupled to the vent pipe stem.

16. The vent cap of claim 12 wherein the backing plate includes a first side and a second side, and a top and bottom, the first outer housing is coupled to the first and second sides of said first portion of said backing plate, the second outer housing is coupled to the first and second sides of said second portion of said backing plate, and the vent cap further includes a bottom cover, positioned at a first side of said second outer housing.

17. The vent cap of claim 16 wherein each of said top cover and middle cover includes at least a first hole, each said first hole positioned adjacent to the exhaust region defined between the divider and the first outer housing.

18. The vent cap of claim 17 wherein said top cover includes at least a second hole and bottom cover includes at least a first hole, each said second hole of said top cover and said first hole of said bottom cover positioned adjacent to the inlet region defined between the divider and the backing plate.

19. The vent cap of claim 16 wherein each said top cover and middle cover includes at least a first plurality of slots, each said first plurality of slots positioned adjacent to the exhaust region defined between the divider and the first outer housing and including an angled flange positioned over the slot.

20. The vent cap of claim 19 wherein said top cover includes at least a second plurality of slots and bottom cover includes at least a first plurality of slots, each said second plurality of slots of said top cover and said first plurality of slots of said bottom cover positioned adjacent to the inlet region defined between the divider and the backing plate.

21. The vent cap of claim 20 wherein each of said plurality of slots has a first side and a second side, said first plurality of slots includes at least one angled flange positioned at the first side of the slot and angled in a first direction; and said second plurality of slots includes at least one angled flange positioned at the first side of the slot and angled in a second direction.

22. The vent cap of claim 16 wherein the top cover includes at least a first and second vertically oriented slot adjacent to said first side and said second side of said backing plate.

23. A vent cap for a direct vent system, the cap comprising:

a backing plate having, a top, a bottom, a first side and a second side and an opening for receiving a two duct direct vent pipe having an inner pipe communicating with an outlet opening of the vent cap and an outer pipe communicating with an inlet opening of the vent cap, said backing plate opening sized in correspondence with the outer pipe;

a first arcuate outer housing secured to a first portion of the backing plate;

a second arcuate outer housing secured to a second portion of the backing plate;

a third semicircular outer housing secured to a third portion of the backing plate, between the first and second portions of the backing plate and between the first arcuate outer housing and the second arcuate outer housing, the third semicircular outer housing having a first edge attached to the first side of the backing plate and a second edge attached to the second side of the backing plate, the first and second edges having a first height, the third semicircular outer housing having an apex with a second height equal to the first height;

a first top cover and a first bottom cover, the first top cover positioned at a top side the first arcuate outer housing and the first bottom cover positioned at a bottom side the second arcuate outer housing, each of the first top cover and the first bottom cover including an inlet aperture in communication with the inlet opening of the vent cap; the third semicircular outer housing including a second top cover and a second bottom cover positioned adjacent to a top side and a bottom side of the third semicircular outer housing, respectively each of the second top cover and the second bottom cover including an outlet aperture in communication with the outlet opening of the vent cap;

a divider coupled between the third outer housing and the backing plate, the divider forming an exhaust region between the third housing and the divider and an inlet region between the divider and the backing plate the exhaust region in fluid communication with the outlet opening and the inlet region in fluid communication with the inlet opening;

a heat shield having a semicircular shape and positioned adjacent to the divider and within the third semicircular outer housing in the exhaust region, the heat shield directly coupled to the divider; and a direct vent pipe coupling in the backing plate.

24. The vent cap of claim 23 wherein the heat shield has an arcuate shape generally matching a cross-sectional shape of the third semicircular outer housing.

25. The vent cap of claim 23 wherein the first and second arcuate housings have a smaller radius of arc than said third housing.

26. The vent cap of claim 23 wherein the coupling is mounted in the approximate center of the exhaust region and inlet region.

27. The vent cap of claim 23 wherein the direct vent pipe coupling is vertically displaced from the exhaust region such that exhaust gases are transferred vertically from the direct vent pipe coupling via an opening of the divider to the exhaust region.

28. The vent cap of claim 23 wherein each said first top cover and first bottom cover includes a plurality of slots, each said plurality positioned adjacent to the inlet region defined between the divider and the backing plate.

29. The vent cap of claim 28 wherein each said slot includes an angled flange positioned over the slot, the flange being angled toward the backing plate.

30. The vent cap of claim 23 wherein each said second top cover and second bottom cover includes a plurality of slots positioned adjacent to the exhaust region defined between the divider and the third semicircular outer housing.

31. The vent cap of claim 30 wherein each said slot includes an angled flange positioned over the slot, the flange being angled away from the backing plate.

32. The vent cap of claim 1 wherein the narrowed apex of the semiconductor outer housing causes the top cover and the bottom cover to be angled with respect to the base plate by approximately 80 degrees.

* * * * *